United States Patent [19]

Spira et al.

[11] 4,350,935

[45] Sep. 21, 1982

[54] GAS DISCHARGE LAMP CONTROL

[75] Inventors: Joel S. Spira, Coopersburg; David G. Luchaco, Macungie; Dennis Capewell, Easton, all of Pa.

[73] Assignee: Lutron Electronics Co., Inc., Coopersburg, Pa.

[21] Appl. No.: 135,091

[22] Filed: Mar. 28, 1980

[51] Int. Cl.[3] ..... H05B 41/392; H05B 41/16

[52] U.S. Cl. ..... 315/291; 315/207; 315/208; 315/210; 315/250; 315/294; 315/324; 315/DIG. 4

[58] Field of Search ..... 315/208, 287, 291, 307, 315/311, DIG. 4, DIG. 5, DIG. 7, 201, 207, 210, 226, 241 R, 250, 294, 297, 312, 313, 324

[56] References Cited

U.S. PATENT DOCUMENTS

| | | | |
|---|---|---|---|
| 3,265,907 | 8/1966 | Kurata et al. | 315/DIG. 4 |
| 3,265,930 | 8/1966 | Powell, Jr. | 315/307 X |
| 3,422,309 | 1/1969 | Spira et al. | 315/DIG. 4 |
| 4,189,664 | 2/1980 | Hirschfeld | 315/297 |

*Primary Examiner*—Eugene R. LaRoche
*Attorney, Agent, or Firm*—Ostrolenk, Faber, Gerb & Soffen

[57] ABSTRACT

The input energy to a gas discharge lamp is controlled over a given range to obtain output light regulation in a controlled fashion for different kinds of gas discharge lamps, including fluorescent lamps, high intensity discharge lamps and others associated with any type ballast, including conventional non-dimming type ballasts. A suitable circuit switches each half wave of an input a-c wave form from some instantaneous value greater than zero to a substantially zero value and then back to a value greater than zero one or more times in each half cycle. The time duration of the substantially zero energy interval is varied to vary the total energy applied to the gas discharge lamps. In a preferred embodiment, a first high speed electronic switch is connected in series with the a-c source and lamp ballast and a high speed electronic shunt switch is connected across the a-c line and ballast input. The series switch is opened to produce the zero energy interval. Simultaneously with the opening of the series switch, the shunt switch is closed to allow discharge of energy stored in the reactive components of the ballast into the lamp. When the series switch is reclosed, the shunt switch is simultaneously opened. Other embodiments are described which include the use of passive energy divertors in place of the shunt switches or across the series switch. Numerous protective circuits protect the control circuit, the lamp and ballast, and the a-c line.

84 Claims, 19 Drawing Figures

TO BALLAST & LAMP
CONTROL SIGNAL
40
SHUNT SWITCH
19
COMPENSATION NETWORK
41
FROM RECTIFIER-35
INTER-FACE
51
30 SECOND TIMER
50
32
BYPASS RELAY
SERIES SWITCH
18
31
BASE DRIVE CIRCUIT
38
CUT-OFF CIRCUIT
34
TIMING ONE SHOT
52
FADE-DOWN CKT.
GATE DRIVE CIRCUIT
33
DELAY ONE SHOT
36
LINE DISTURBANCE DETECTOR
37
FULL WAVE RECTIFIER
35
13
30
14

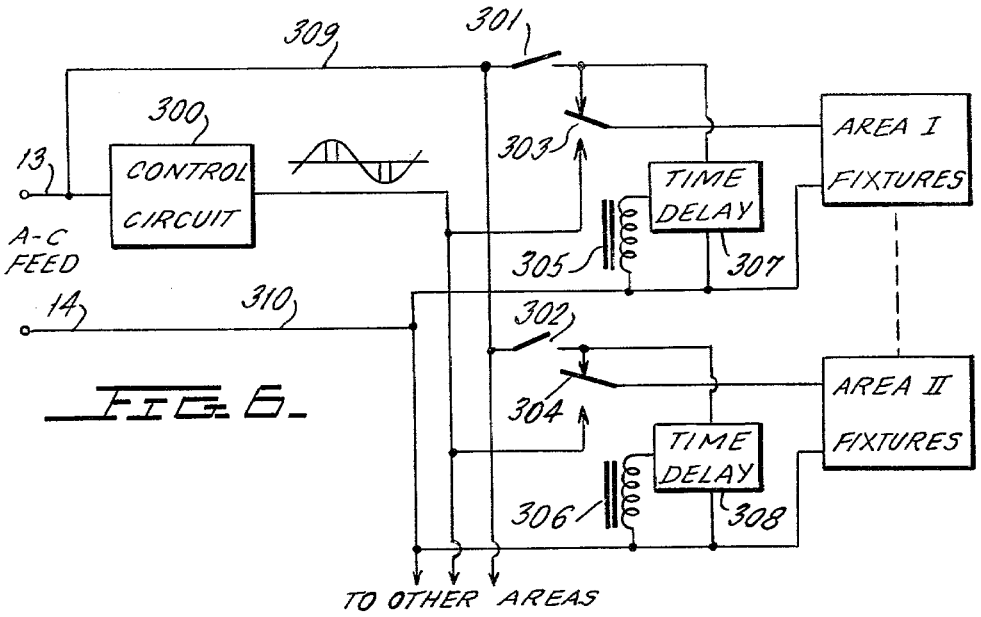
FIG. 6
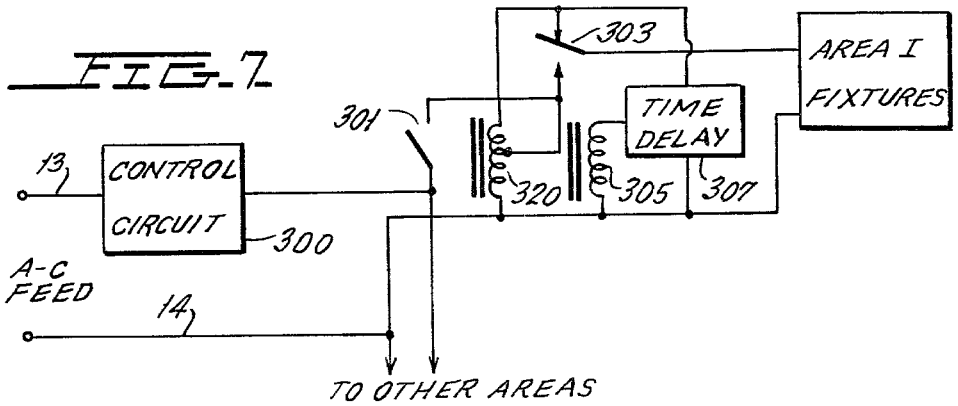
FIG. 7
FIG. 8
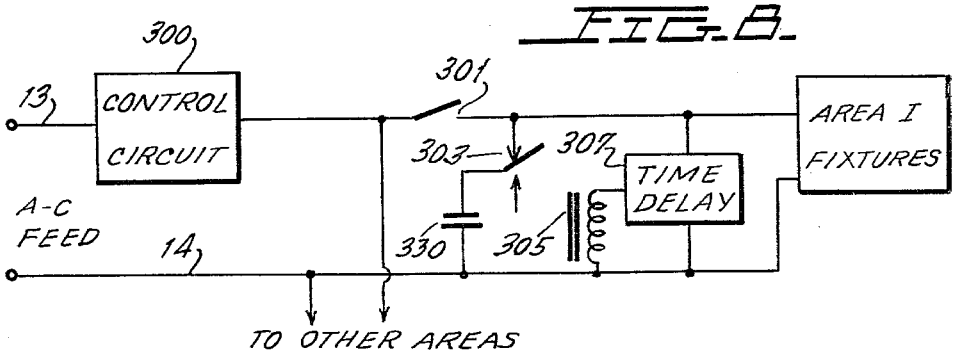

GAS DISCHARGE LAMP CONTROL

BACKGROUND OF THE INVENTION

This invention relates to circuits for energizing gas discharge lamps, and more specifically relates to a novel control circuit for a gas discharge lamp which can permit the dimming of lamps associated with conventional non-dimming ballasts.

Gas discharge lamps are widely used as illumination sources. As hereinafter used, gas discharge lamps include fluorescent lamps with or without separate heaters. High Intensity Discharge (HID) lamps, and all other lamps which generally exhibit a negative resistance characteristic. Such lamps require ballast circuits to provide a stable operating condition when they are used with standard a-c power sources. This is because the plasma arc within the lamp has a negative resistance characteristic which requires a series ballast impedance to achieve a stable operating point. Other functions of ballasts are to provide additional striking voltage to start the lamp initially and, in some cases, to provide power for internal lamp cathode heaters.

The ballasts are usually installed in or very near each lighting fixture containing the one or more lamps with which they are associated. Generally each ballast will only operate one or two lamps. The ballast is mounted in close proximity to its lamps and generally directly in the same fixture to make it self-contained and simplify wiring during assembly. Consequently, access to the interior circuitry of a ballasted gas discharge lamp assembly is physically limited. Moreover, the fixture is frequently mounted overhead so that access to the fixture and the ballast components is limited.

It is known to be desirable to modify existing non-dimming gas discharge lamp assemblies so that their output light can be modified or dimmed when 100% of their available light output is not necessary. It would also be desirable to make new lamp installations with the dimming capability but using commercially available and relatively inexpensive non-dimming ballasts.

Thus, substantial energy savings can be made if the output of gas discharge lamps is reduced when regions they are to illuminate are partly illuminated by other sources such as sunshine entering a room to be illuminated. Energy can also be saved by reducing the output of a gas discharge lamp when it is new and when its output is substantially greater than at the end of its useful life. Known systems provide lamp dimming which will provide a given ambient illumination so that the energy used by the lamp is only the energy needed to bring the illumination level in a given area at a given time to its desired value. This can substantially reduce energy cost and use.

Existing systems can be modified to be capable of dimming by replacing the existing ballast in a fixture with a ballast capable of operation in a dimming mode, or by suitably controlling the input power. Thus, the gas discharge lamp ballast can be replaced by a variable series inductor. This, however, is an expensive and complex structure and, moreover, the device could not be retrofitted easily into a standard fixture.

It is also possible to provide a variable amplitude a-c input source through the use, for example, of an autotransformer while maintaining a fixed ballast impedance. The variable autotransformer, however, is expensive and physically large. Moreover, the line voltage in such a device would have to be substantially higher than lamp operating voltage to permit striking of the lamps. Furthermore, means must be provided to prevent the reduction of heater voltage if the lamps employ a cathode heater since the operation of the lamps at low heater voltage will substantially reduce their life.

Other arrangements have been proposed employing series ballast inductances which can be selectively short-circuited as shown, for example, in U.S. Pat. No. 3,816,794. A device of this type is not well suited for retrofit installation and is very costly since its use would require the dismantling of existing fixtures and the running of additional conductors to enable the selective short-circuiting of one or more of the inductors.

Dimming ballasts are also known which use thyristor type circuits for controlling the application of a phase controlled input current to a gas discharge lamp, such as a rapid-start fluorescent lamp. In these arrangements, the primary winding of the dimming ballast is always at full line voltage so that heater voltage can be kept high during the dimming cycle. However, it would be very difficult to modify an existing gas discharge lamp installation to employ such a dimming ballast since it would require access to and modification of the ballast in the fixture and additional wiring to the fixtures.

The need for an additional wire for a dimming ballast can be eliminated by using a ballast circuit of the type shown in U.S. Pat. No. 3,422,309, entitled FLUORESCENT LIGHT DIMMING SYSTEM, in the name of Spira et al, and assigned to the assignee of the present invention. In this device, thyristors are disposed in series with a two-wire dimming ballast. Special circuits are needed to maintain heater voltage at a sufficiently high level during dimming to prevent damage to the tube. Moreover, the retrofitting of this ballast into an existing non-dimming ballast installation would be complex and expensive.

The ballast configuration of U.S. Pat. No. 3,422,309 above uses conventional phase control, whereby the firing angle of the thyristor is delayed by a greater or lesser extent to control the conduction time during which current is applied to the ballast. Other control systems are known which employ a form of reverse phase control, whereby current flow begins at the beginning of a half cycle but is terminated before the end of the half cycle. By terminating the point at which current flow is stopped, one employs a form of phase control. Circuits of this type have been manufactured and sold under the name Ecostat by Evers GmbH; Eichofstrasse 14, 2300 Kiel 1 W. Germany.

The Ecostat arrangement permits energy stored in a reactor ballast and power factor correction capacitor to be discharged into the gas discharge lamp after a transistorized a-c switch is opened. This then serves to limit the deionization of the gas discharge lamp during the switch-off interval. The use of this arrangement in an existing installation, would, however, require the complex modification of the standard non-dimming ballast.

The use of reverse phase-controlled circuits for dimming incandescent lamps is also disclosed in a paper by Burkhart and Ostrodaki, entitled REVERSE PHASE-CONTROLLED DIMMER FOR INCANDESCENT LIGHTING, in the I.E.E.E. Transactions on Industrial Applications, Volume 1A-15, No. 5, September/October 1979, pages 579 through 583.

Another method for ballasting of gas discharge lamps, so they can be dimmed, is the use of an electronic current limiting circuit in place of the standard magnetic ballast as is shown and described in U.S. Pat. No. 3,619,716, entitled HIGH FREQUENCY FLUORESCENT TUBE LIGHTING CIRCUIT AND A-C DRIVING CIRCUIT THEREFOR, Spira et al, and assigned to the assignee of the present invention. While this device achieves increases in efficacy of up to 25% with fluorescent lamps and somewhat less for high intensity discharge lamps and produces very attractive performance, the system would also require major modification of a non-dimming installation to be retrofitted.

Another dimming arrangement is known, made by Controlled Environment Systems Inc., of Rockville, Md., known as the "E.C.A.L.O." system. This system operates a fluorescent lighting system having standard ballasts in a dimming mode.

Most installations containing non-dimming ballasts will contain a ballast design which is a type known as a "regulating autotransformer ballast". The so-called regulating autotransformer ballast consists of an autotransformer having a primary winding portion connected to the a-c mains and a secondary winding portion connected in closed series relation with a series capacitor and the gas discharge lamp or lamps. The primary and secondary portions are loosely coupled by the autotransformer leakage inductance.

None of the known gas discharge lamp control systems described previously provide satisfactory performance when used with regulating autotransformer ballasts. Thus, the use of a series impedance or autotransformer scheme results in rapid loss of filament voltage and cycle-to-cycle restriking voltage, resulting in limited control range before the lamps either go out or are in danger of damage due to low heater voltage.

Conventional phase control schemes and the reverse phase angle control schemes, when applied to the conventional regulating autotransformer ballast, will provide significant dimming control to about 40% or less of the rated output before the lamps go out. However, line power factor deteriorates very rapidly so that the RMS line current into the system might actually increase as the lamp output is reduced. This increase can be as much as 50% above the line current at 100% rated light output when lamp output is reduced to about 30% with a high intensity discharge lamp. This would then increase ballast and distribution system losses and increase line current to the extent it might cause branch circuit breakers to operate. Also the amount of ballast input voltage reduction required to obtain satisfactory dimming will result in lamp filament voltages of rapid start fluorescent lamps being reduced to such an extent as to have an adverse effect on lamp life and dimming control.

BRIEF DESCRIPTION OF THE INVENTION

In accordance with the present invention, a novel circuit is provided for energizing gas discharge lamps which circuit can permit the dimming of conventional ballasts and lamps in an existing installation or which can be incorporated into a new installation using conventional ballasts for the lamp. A significant feature of the invention is that the novel circuit can be connected to the line without modification of non-dimming standard ballasts and lamps. Thus, the novel invention can be connected at any convenient location in a building being equipped with the new system without need to disrupt users of the building or add wiring to the system.

In accordance with a first aspect of the invention, the wave shape of the energy supplied to one or more ballast and lamp assemblies is modulated to have one or more substantially zero energy regions in each half cycle. Thus, in effect, one or more "notches" is placed in the wave form. Preferably, the notches occupy the same angles in the positive and negative half waves. The width of these notches may then be electronically controlled in order to control the total energy applied to the lamp during any half cycle preferably by adjusting the location of the trailing edge of the notch. By modulating the half wave in this manner, as contrasted to prior art modulation (conventional phase control and reverse phase control) the instantaneous voltage applied by the ballast to the lamps is relatively high even during dimming, and heater voltage can be maintained high. Thus, lamps operated by conventional non-dimming ballasts will not have their life reduced even though they are being dimmed. Moreover, the novel circuit can be connected to existing wiring remotely from the fixtures so that the fixtures do not have to be removed or modified in a retrofitting operation.

The use of a notched energy wave form for electric circuits, particularly for a-c choppers is known but has never before been used in connection with a control circuit for a gas discharge lamp. Disclosures of such circuits are in the following papers:

AC POWER CONTROL OF AN R-L LOAD by Kirshnamurthy, Dubey and Revankar, I.E.E.E. Transactions on Industrial Electronics and Control Instrumentation, Volume IECI-24, No. 1, February 1977, pages 138 through 141;

SYMMETRICALLY PULSED WIDTH MODULATED AC CHOPPER by Revankar and Trasi, I.E.E.E. Transactions on Industrial Electronics and Control Instrumentation, Volume IECI-24, No. 1, February 1977, pages 39 to 44;

A PULSE-WIDTH CONTROLLED AC TO DC CONVERTER TO IMPROVE POWER FACTOR AND WAVEFORM OF AC LINE CURRENT by Kataoka, Mizumachi, Conference Record, 1977 IEEE/IAS International Semiconductor Power Converter Conferences, pp. 333–339.

A second aspect of the invention is a specific circuit for producing the novel wave shape. In accordance with this aspect of the invention, the control circuit includes an electronic series switch which is connected in series with the a-c power source and ballast, and an electronic shunt switch connected in parallel with the ballast. The series and shunt switches can be any desired type controllably conductive devices, such as switching transistors, thyristors, triacs and the like arranged to accomplish a-c switching. The series switch is opened at some instant when it is desired to notch the half cycle wave form of the energy applied to the ballast. The length of time the series switch remains open will determine the width of the notch and the total energy applied to the ballast and lamp in any half cycle. This length of time will be suitably controlled as will be later described.

The shunt switch is arranged to close when the series switch opens and to open when the series switch closes. In this way, the energy stored in the ballast will discharge through the lamp during the interval the series switch is opened. Since energy circulates through the lamp during the time the series switch is open, the lamp will not deionize while the series switch is opened and energy stored in the ballast will operate the lamp during the interval the ballast is disconnected from the line. The shunt switch will also reduce voltage surges on the series switch. Alternatively, the function of the shunt switches may also be accomplished by other suitable energy divertor means, such as passive reactive elements, when the series switch is suitably controlled.

The use of cooperating series and shunt switches is known for use in connection with inverters and is disclosed in a paper entitled TRIACS-POSSIBLE USES AND THEIR FUTURE-Revankar and Trasi, Volume III, No. 3, 1975, Electrical and Electronics World. However, the use of combined series and shunt switching has never been described in connection with a circuit for controlling gas discharge tube lighting.

A third aspect of the invention involves a novel arrangement of protective and control circuits which enables the circuit to start-up and shut-down either manually or in response to faults on the line without damage to the lamps, the control circuit or the outside voltage source.

The protective circuits include:

(a) a bypass relay for the main series switch which short-circuits the series switch during circuit start-up and shut-down. Closing the relay during circuit start-up prevents damage to the circuit series switch due to high in-rush current to the ballast and prevents damage to the lamps due to starting under possibly reduced voltage conditions; closing the relay during shut-down protects the series switch against damage due to contactor bouncing;

(b) a drop-out circuit which shuts down the circuit in response to predetermined line fault conditions or overvoltage or undervoltage conditions with automatic restart of the circuit if the fault disappears after a given time;

(c) an automatic light output regulation circuit for regulating the energy to the lamp by adjusting the notch width in response to changes in line voltage;

(d) an input capacitor to absorb high voltage spikes produced during the operation of the series switch;

(e) logic circuits and a power supply therefor which ensure symmetry in the location and width of the notch or notches in positive and negative half cycles thereby to minimize any d-c component of the voltage being fed to the ballasts;

(f) rate-of-change limiting circuits to prevent the lamp from extinguishing during rapid changes in light output by allowing the lamp plasma arc sufficient time to stabilize as the light output is changed.

While the circuit of the invention can be advantageously used for dimming lamps having a conventional ballast, the circuit of the invention can also be used in connection with a system which does not require dimming. Thus, a circuit can be provided for a non-dimming application which uses the novel notched wave form of the invention obtained, for example, by a circuit using series and shunt switching, and the protective circuits which were described. The system would have the advantage that the conventional ballasts could be reduced in size and a lower effective ballast input voltage will produce the same light output. Thus, the invention can permit the use of a smaller ballast in a given installation by virtue of its ability to reduce the effective ballast input voltage from standard branch circuit levels to the minimum necessary to maintain lamp arc stability while using a relatively simple and low loss series reactor type of ballast. Also, normal variations in the a-c supply voltage can be removed by the invention and a constant voltage provided to the ballast. This will further reduce ballast size and complexity, since it is no longer necessary for the ballast to compensate for said supply variations.

The operation obtained with the novel invention has numerous advantages including the following:

1. The novel invention has unique applicability to gas discharge lamp systems and has the ability to be dimmed, thereby to save energy while continuously varying light output with energy saved in proportion to reduction in light output, with savings of 50% in energy readily obtained.

2. The invention has the ability of being installed in an existing installation without requiring access to the fixtures, the individual lamps or the ballast wiring.

3. The use of the novel invention relies on electronic control and, therefore, can be easily interfaced with automatic energy management control.

4. An important advantage of the invention is that it can be used with a wide variety of lamps and ballasts. In addition, it can work with any desired number of lamp and ballast combinations without need for adjustment.

5. The amount of energy stored in and transmitted by the ballast when the series switch is open is reduced as light output falls, so ballast losses are correspondingly reduced.

6. The ballast stored energy is dissipated usefully and is converted into light output by the lamp.

7. The gas discharge lamp arc is prevented from deionizing during the interval the series switch is off by diversion of the stored ballast energy to the lamp. This greatly reduces stress on the lamp due to elimination of the need to fully restrike the arc with each half cycle of the a-c wave form and also allows dimming to a lower level before the lamp drops out of conduction.

8. Stored energy in the ballast cannot return to the line due to the open series switch so that good displacement power factor characteristics are obtained over the full control range.

9. Electronic series and shunt switches or passive energy divertor means have very low energy losses so that very little energy is dissipated in the control circuit.

10. Opening the series switch at an appropriate time eliminates peaking of the lamp current and improves lamp peak-to-RMS current ratio and lamp power factor.

11. The shunt switch or passive energy divertor minimizes voltage surge across the series switch and other circuit components and reduces energy momentum effects such as inductive flyback voltage by diverting such energy through the ballast to be dissipated in the lamp load.

A further feature of this invention is an arrangement which permits different banks of lamps energized from a single circuit of the type described to be turned on and off independently of one another.

A single control unit may be sized to control a given number of lamps, typically 90 forty watt rapid start fluorescent tubes. However, these 90 lamps may be divided among several areas which are turned off and on independently of each other by local switching arrangements. The dimmed wave form output, however, is not suitable for initially striking the gas discharge lamps of the bank which was off. This is because notches reduce the energy content sufficiently that a standard ballast cannot produce enough peak voltage and/or heater power to reliably strike a gas discharge lamp which has been completely turned off for any significant period of time (i.e. greater than a few seconds). In accordance with this feature of the invention, means are provided to increase the energy content of the output wave form temporarily when the local switching mechanism is initially energized to ensure reliable lamp starting. This energy increasing means can take many forms such as a step-up transformer to temporarily increase the voltage to the bank turning on; a switching circuit which provides energy during the notch interval for a short time following turn on, and the like.

BRIEF DESCRIPTION OF THE DRAWINGS

FIGS. 6, 7 and 8 show embodiments of the invention employing individual switching of local banks of fixtures.

DETAILED DESCRIPTION OF THE DRAWINGS

Figure 1:
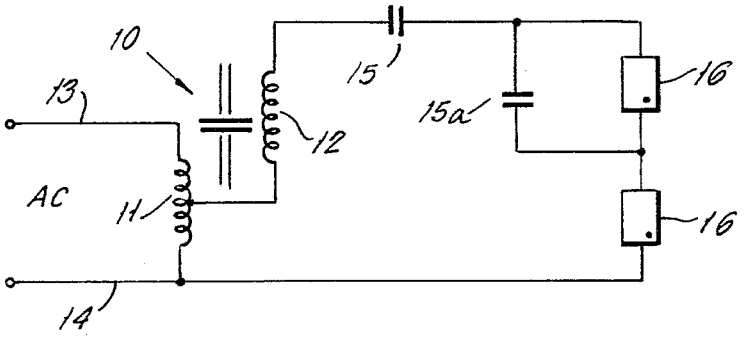
FIG. 1 (PRIOR ART)
FIG. 1 shows a conventional regulating ballast.
Figure 1A:
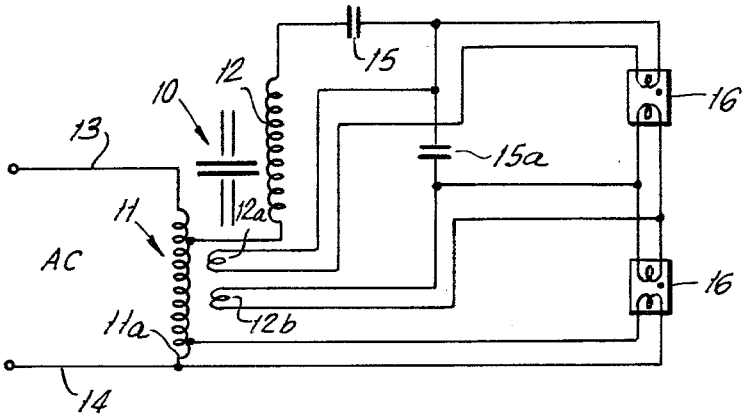
FIG. 1a (PRIOR ART)
FIG. 1*a* shows a conventional regulating ballast for gas discharge lamps of the type having heater windings.

Referring first to FIG. 1, there is illustrated therein a regulating autotransformer ballast which is most frequently used in gas discharge lamp installations. A typical ballast used in the circuit of FIG. 1 is Universal Type 593-SL-TC-P. FIG. 1*a* shows the circuit modified to have cathode heater windings for heating the filaments of a fluorescent lamp if the gas discharge tube is of this type. The ballast in FIG. 1*a* can be Universal Type 443-LR-TC-P.

The ballast of FIGS. 1 and 1*a* consists of an autotransformer 10 having a primary winding 11 and secondary winding 12, as schematically illustrated. A leakage shunt is schematically shown to indicate that windings 11 and 12 are not tightly coupled. The primary winding 11 is connected to the a-c power lines 13 and 14. Winding 12 is connected in series with a series capacitor 15 and two series-connected gas discharge lamps 16. A starting capacitor 15*a* is connected across one lamp 16.

In FIG. 1*a*, lamps 16 are shown with heater filaments which are heated by connection to secondary windings 12*a* and 12*b* and winding tap 11*a* of winding 11, as shown.

The gas discharge lamps 16 can be of any desired type and may include such lamps as rapid-start fluorescent lamps (FIG. 1*a*), instant-start fluorescent lamps, High Intensity Discharge Lamps, high intensity lamps and the like. Conventionally, the ballast components 10 and 15 will be mounted in the same fixture with the lamps 16 for compactness and to avoid the need for extra wiring during installation.

In a ballast of the type shown in FIG. 1, the basic ballasting impedance function of the lamp arc is obtained from the series combination of the autotransformer leakage inductance and the series capacitor 15. The net ballasting impedance is the difference between the capacitive and inductive reactances at the a-c line frequency which conventionally would be 50 to 60 Hertz. The autotransformer 10 provides a high open circuit voltage which is needed to initially strike the arc in the gas discharge lamp 16 and the tapped primary winding 11 provides impedance matching between the a-c lines 13 and 14 and the lamps 16 to provide good power factor characteristics and good regulation characteristics of the lamp power.

By providing suitable saturation characteristics for the autotransformer 10, a high degree of automatic compensation for variation in line voltage is obtained so that lamp output is relatively independent of small line voltage changes. The series capacitor 15 prevents the flow of d-c current during the initial striking phase of the lamps 16. This is important, particularly with high intensity discharge lamps since it avoids large current surges which are common with reactor ballasts of such lamps. The regulating ballast also provides for lower than normal line current during the warm-up phase common to many kinds of gas discharge lamps. The same ballast is frequently used with fluorescent lamps, where, in the case of FIG. 1*a* the cathode heaters will be connected to suitable taps on the transformer windings 11 and 12.

Because of these characteristics, the regulating autotransformer ballast of FIG. 1 is used in most gas discharge lamp installations.

Fixtures in existing buildings are usually mounted in the ceiling and are not conveniently accessible. If an existing non-dimming intallation is to be modified to be capable of dimming, modification of the ballast and its wiring is usually necessary, and considerable expense and dislocation is involved. As will be later seen, the novel invention can be used to dim the gas discharge lamps 16, retaining the standard ballast of FIG. 1, without degrading the operation of the lamp or substantially affecting the power factor of the system.

Figure 2:
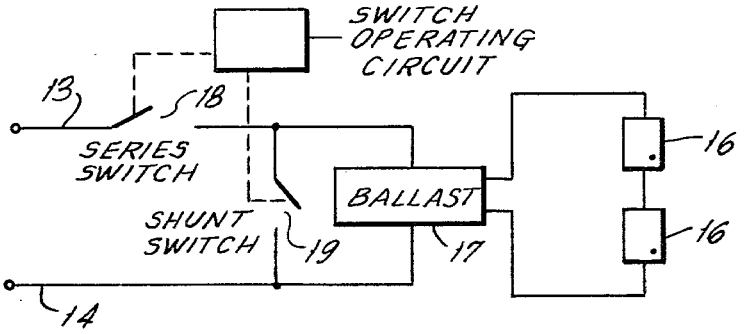
FIG. 2 is a schematic diagram of the basic circuit of a preferred embodiment of the present invention.

The present invention provides a novel control circuit for energizing gas discharge lamps 16 of FIGS. 1 and 1*a*. The basic circuit is shown in FIG. 2 for lamps 16 and their ballast 17, which may be a ballast of the kind shown in FIGS. 1 and 1*a*. In a preferred embodiment of the invention, ballast 17 is a high power factor ballast e.g. one with a power factor greater than 0.9. However, in other embodiments, a lower power factor ballast can be used. In accordance with the invention, a high speed series switch 18 is connected in series with the line 13 and the ballast 17 while a high speed shunt switch 19 is connected across the ballast 17 with one end connected to the series switch 18 and the other end to the line 14.

A novel switch operating circuit is then provided for the switches 18 and 19 which will be later described in detail which selectively opens series switch 18 and at substantially the same instant closes shunt switch 19. After a given adjustable delay, switch 18 recloses and switch 19 reopens at about the same instant. The series switch 18 is preferably operated so that it opens symmetrically on positive and negative half cycles to form at least one interval of substantially zero energy during each half wave of the energy applied from lines 13 and 14 to the ballast 17 and lamps 16. By wave form of the energy applied to the lamp and ballast is meant the wave form of one or both the voltage and current or their product, applied to the ballast or lamps. Typical a-c wave patterns arranged in accordance with the invention are shown in FIGS. 3*a* to 3*f* which will be later described. The intervals of substantially zero energy flow are referred to hereinafter as a "notch" in the a-c wave shape. By "notch" is meant an interval of reduction in energy from some instantaneous value to substantially zero between but not including zero energy crossover points of the half wave. A notch is intended specifically to distinguish from arrangements incorporating conventional phase control or reverse phase control whereby energy is either delayed from flowing from and including the beginning of a half cycle, or toward and including the end of a half cycle.

The present invention may, in some cases, use a control wave form which includes periods of substantially zero energy transfer at either or both zero crossover points in combination with a novel energy divertor means to allow recirculation of ballast stored energy to the lamp load. In these cases the novel energy divertor means in combination with the periods of substantially zero energy transfer distinguishes the invention from conventional phase control or reverse phase control arrangements.

A plurality of notches can be used and their locations can be distributed over the entire half cycle wave shape. The width of the notch may be controlled in order to control the total amount of energy transferred from the a-c line to the gas discharge lamp as will be later described. Preferably, the notch width will be controlled by controlling its trailing edge. However, under certain conditions, it may be advantageous to control the leading edge, or both leading and trailing edges. Also, the total excursion and rates of movement of both edges do not have to be equal.

Figure 3A:
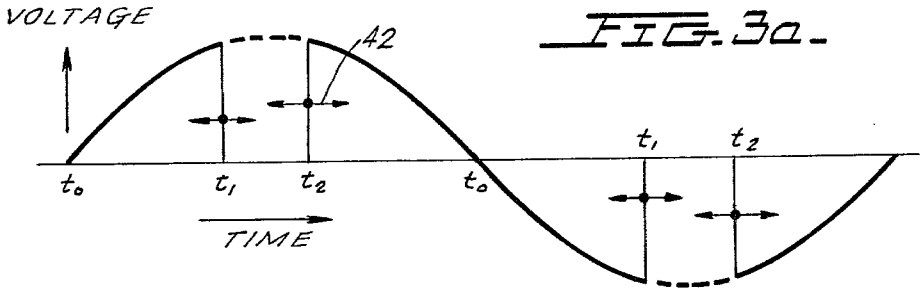
FIG. 3*a* schematically illustrates one notched wave form which can be used in accordance with the invention for applying energy in a controlled fashion to a gas discharge lamp and ballast using a single, generally centrally located notch in the wave form.

Referring to FIG. 2, and using a control pattern having only a single notch as shown in FIG. 3*a*, as the line voltage between lines 13 and 14 increases from time $t_0$ to time $t_1$, the series switch 18 is closed and the shunt switch 19 is opened so that energy is transferred from lines 13 and 14 to ballast 17 and lamps 16. At time $t_1$ the series switch 18 is opened and shunt switch 19 is closed. Energy stored in the ballast reactance can then be dissipated in the lamp load 16. This stored energy thus operates the lamp during the interval between $t_1$ and $t_2$ in FIG. 3*a*. At time $t_2$ the series switch 18 recloses and shunt switch 19 reopens. This occurs preferably after the stored energy in the ballast has decayed to a suitable level, and energy again flows from the a-c line to the lamp 16.

Since energy flow from the a-c lines 13 and 14 was interrupted for a significant portion during each half cycle, the net energy delivered to the lamp will be reduced. This will result in a reduction in both lamp output (lamp dimming) and ballast power input. In order to vary the degree of dimming, it is only necessary to change the notch width, for example, by changing time $t_2$ at which the switch 18 is reclosed. Of course, the width also could be varied by changing time $t_1$ at which time switch 18 is opened and holding $t_2$ fixed, or by varying both $t_1$ and $t_2$.

In the next half cycle and as shown in FIG. 3*a*, a symmetrical operation will take place at related times $t_0$, $t_1$ and $t_2$.

The mode of operation described above has numerous advantages. Included among these advantages is the possibility of dimming without requiring direct access to conventional ballast 17 or the fixture containing the lamp 16 and ballast 17. Moreover, a single control circuit can operate a plurality of ballast and lamp conditions.

An important advantage of the novel circuit of the invention and the use of a wave form containing at least a single notch is that the arc in lamp 16 will not deionize during the time the series switch 18 is off. This greatly reduces the stress on the lamp by eliminating the need to fully restrike the arc during each half cycle of the a-c wave form maintaining lamp lifetime and allowing dimming to lower light output levels, thereby increasing energy savings.

Another advantage of the arrangement of FIG. 2 is that if the gas discharge lamp 16 has heater windings operated from the ballast 17 (as in FIG. 1*a*), the heater winding voltage will be maintained high relative to that obtained with ordinary dimming schemes even though the lamp output is decreased, since the root-mean-square value of the input voltage applied to ballast 17 remains high. The novel circuit of the invention also permits the ballast 17 to retain a good displacement power factor characteristic since instantaneous voltage and current tends to remain in phase.

It will also be apparent that the high speed electronic switches 18 and 19 will have a relatively low voltage drop as compared to the operating voltage so that very little energy is dissipated in the circuit itself.

The notched wave form which is selected can take the form of any of FIGS. 3*a* through 3*f* or any other form which will be suggested to the designer to carry out the purposes of the invention.

Figure 3B:
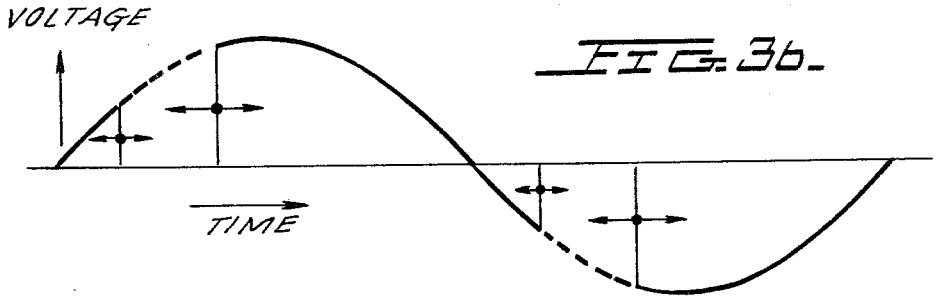
FIG. 3*b* shows an alternative wave form which could be used in accordance with the invention showing the notch located off the center of the wave form.

As shown in FIG. 3*b*, the position of the notch can be displaced to the front of the wave form.

Figure 3C:
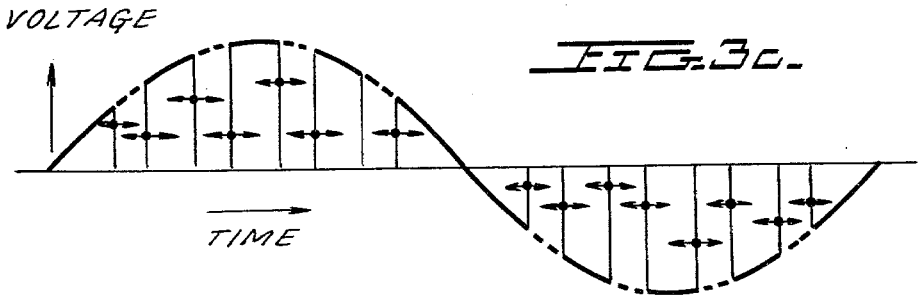
FIG. 3*c* shows an alternative wave form using a plurality of notches.

As shown in FIG. 3*c*, any number of notches can be used symmetrically in the positive and half wave cycles of the energy wave form.

Figure 3D:
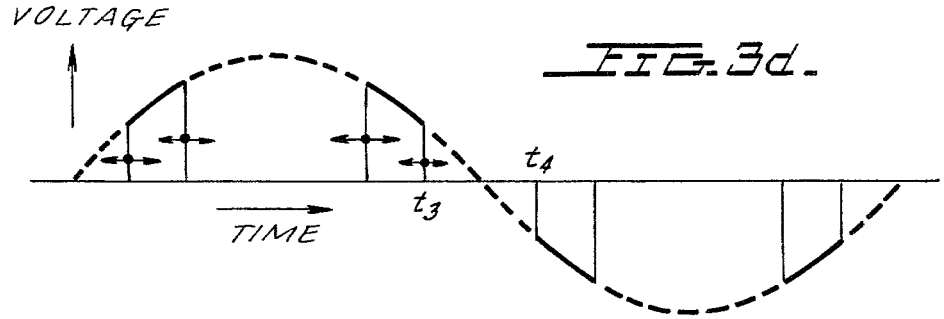
FIGS. 3*d* through 3*f* show other typical notched wave shapes which can be used in accordance with the invention.

As shown in FIG. 3*d*, the wave form can be divided into a central notch and, moreover, the wave form can be interrupted at its zero crossover points where relatively little energy can be transmitted to the lamp. Thus, very little light output is lost by opening switch 18 at times corresponding to times $t_3$ and $t_4$ in FIG. 3*d* and during low energy transfer regions but systems losses are further reduced and additional energy is saved.

Figure 3E:
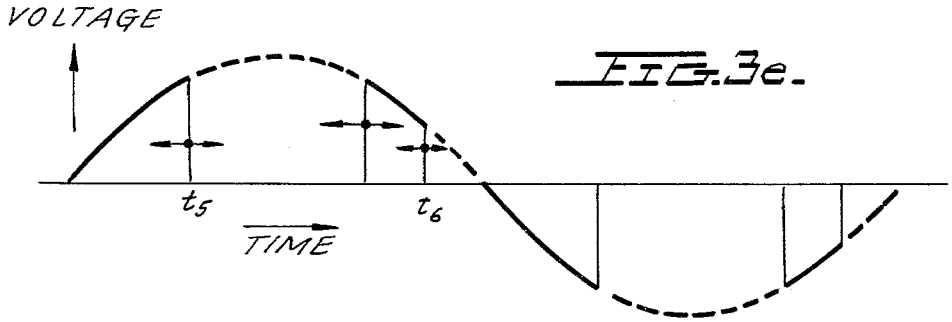

As shown in FIG. 3*e*, the wave form can incorporate the initial portion of the half wave cycle which was eliminated in FIG. 3*d* and the times $t_5$ and $t_6$, at which the switch 18 is opened, can each be varied to obtain dimming control. Of course, any suitable means of varying the "off" time of switch 18 can be used.

Figure 3F:
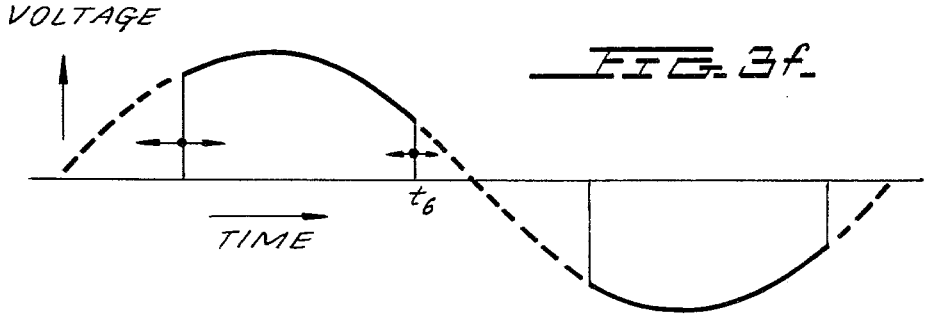

As a final example of the wave form, the pattern of FIG. 3*f* can be used, wherein only the energy immediately in the region of the zero crossover points is eliminated, with control being obtained by varying time $t_6$ at which switch 18 is opened.

The specific selection of a particular wave may be left to the designer. He may wish to select a large number of interruptions or notches in each half cycle to obtain the advantage of operating the tube at a relatively high frequency with very good power factor. This, however, might produce a high order of harmonic content in the line current which would have to be filtered. Also the means of modulating the leading or trailing edges of the notch or notches may be modified as indicated above. Conversely the width of the notches may be held constant and the number of notches per half cycle may be varied to effect dimming control, or a combination of several methods may be used.

The pattern selected for use with the preferred embodiment of the invention is that shown in FIG. 3*a*. The use of a single notch which is approximately aligned with the peak of the a-c supply voltage is helpful in reducing the tendency of an inductive ballast to produce a peaked lamp current wave form. This lamp current peak also is approximately aligned with the peak of the a-c supply under normal full output operating conditions. By notching the voltage applied to the ballast as described above, the ballast input voltage is reduced at the same time that the lamp current peak would normally occur, with the result that the total current peak due to lamp and ballast effects is significantly reduced. Therefore, dimming is carried out with a minimum total peak current, reduced lamp current crest factor and reduced RMS line current, thereby maximizing lamp life and line power factor, respectively.

While the ballast 17 in FIG. 2 can be of the type shown in FIG. 1, it should be recognized that the invention is not limited to use with any particular kind of ballast and can work effectively with any low frequency magnetic ballast such as those of the low power factor reactor type.

Preferably, however, the ballast should not have a large parallel power factor compensation capacitor across the input line since this could cause extremely high peak currents when the series switch is reclosed. In such an event, a small series inductance could be added to limit the current. Alternatively, the power factor correction capacitor could be moved to the a-c line side of the switches.

The exact location of the off period or notch or notches in each a-c half cycle is important to achieve optimum operating characteristics. This, however, is a function of the particular characteristics of the lamp and ballast.

In general, the off periods should occur during the portion of the wave form when the ballast is normally storing and transferring the greatest amount of energy. This allows the desired lamp output reduction to be achieved with a minimum total off time. This is desirable because it results in a minimum amount of lamp deionization and minimizes the arc current crest factor. Also, distortion of the a-c line current is minimized and, in the case of rapid-start fluorescent tubes, heater power at dimmed settings is maximized. As a result, proper location of the off periods will result in maximum line power factor and minimum stress on the lamp electrodes.

Ballast-to-ballast component variations appear to have the least effect when off periods are located in a general central region of the a-c wave form so that tracking of the lamps in a multi-ballast system is optimized.

A related consideration in the location of the off period or periods or notch or notches is that as gas discharge lamp is reduced in output, its impedance tends to rise since the voltage of the arc remains relatively constant as the current is being reduced. This increase in the resistive component of the load shifts the relative phase angle between the ballast input voltage and current. In a regulating autotransformer of the type shown in FIG. 1, for example, the shift will be to make the input appear more inductive with the current lagging voltage. For best results, it is also preferable to shift the center of the off period or notch to points in a later location in the a-c half cycle.

In the preferred embodiment, and at 277 volts, 60 Hertz, the notch starts at about 3.2 milliseconds following the waveform zero crossing and varies in width from zero milliseconds (no regulation) to about 2 milliseconds. At 2 milliseconds width of the notch, about 20% light output will be obtained from the typical fluorescent lamp.

When the notch is placed in an earlier portion of the a-c half cycle and with particular lamps and ballasts, the curve of light output versus off times is not very smooth but contains regions of very different slope. This makes it difficult to adjust light input to predetermined values.

As will be later seen, the control circuit for operating series switch 18 is preferably arranged that the lamps are always initially struck without dimming and with full line voltage applied to the ballast. They will then reach their operating temperature quickly and can later be regulated for dimming. By striking the lamps with full line voltage and allowing them to come up to operating temperature before dimming, lamp life is preserved. If the lamps are struck in a dimmed condition, it is possible to damage the lamps and limit their life because of excessive operation in the cold cathode discharge mode which exists before the lamps come up to their full operating temperature.

Figure 2A:
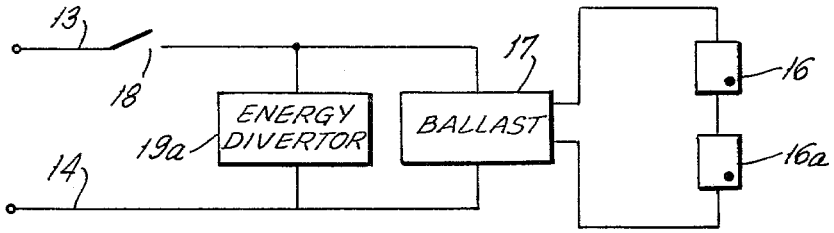
FIGS. 2*a* and 2*b* show second and third embodiments, respectively, of circuits for carrying out the present invention.
Figure 2B:
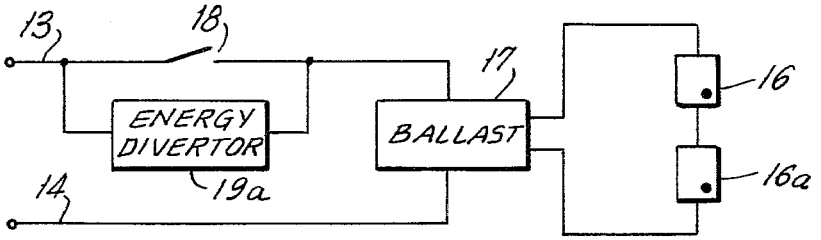

FIGS. 2*a* and 2*b* show an alternative circuit arrangement to that of FIG. 2, wherein the shunt switch 19 is replaced by an energy divertor means 19a which may be connected either in closed series relationship with the series switch 18 or the ballast 17 as shown. This energy divertor 19*a* serves the same function as the shunt switch 19, in that it may allow ballast stored energy to be recirculated through the lamp load during periods when the series switch 18 is open, and it protects series switch 18 from excessive electrical stress due to the energy momentum effects of the ballast stored energy. The advantage of an energy divertor over a shunt switch is that the energy divertor 19*a* may be a passive circuit element, while the shunt switch is an active element. As a result, the use of an energy divertor will generally result in a less complex circuit which is better able to withstand any unusual stress conditions as may occur due to line or load transients or inadvertant fault conditions such as miswire or overload.

In the foregoing, the term energy divertor is intended to cover switching devices and passive circuit components such as capacitors, inductors and resistors, and combinations of switching devices and passive circuit components.

Suitable energy divertors include both reactive and dissipative elements. However, dissipative energy divertors, such as resistors or zener diodes, while providing appropriate protection for series switch 18, generally allow only a small portion of the energy stored in ballast 17 to be returned to the lamps. Therefore, the performance of dissipative energy divertors is generally poor with respect to maintaining lamp ionization during the time series switch 18 is open. Also, since a dissipative element diverts energy by transforming it into heat, the efficiency of the controller will be relatively low if a dissipative energy divertor is used. Reactive energy divertors, such as inductors or capacitors, divert energy by temporarily storing it as magnetic flux or electrical charge, and then return most of the stored energy at some later point in the operation of the control scheme. Generally, connecting such a divertor across the ballast will result in a maximum amount of energy returned to the lamps as in FIG. 2*a*. However, it is also possible to connect as shown in FIG. 2*b*, in which case energy is diverted to both the lamp and the a-c supply. In this case, during notch intervals, energy flow through the open series switch is substantially zero, as it is in all previously described embodiments of the invention. Energy flow from the a-c supply, though significantly reduced, is not completely eliminated, since the divertor provides an alternate path between the ballasts and the a-c supply when the series switch is open. Generally, such an arrangement as shown in FIG. 2*b* will result in greater lamp deionization and poorer line power factor, but has the advantage of not requiring a connection to the return side of the a-c supply (line 14), which may simplify the system in certain applications. FIGS. 2*a* and 2*b* have in common a closed series connection where, in FIG. 2*a*, the closed series connection includes the source. The use of passive reactive divertors is particularly attractive when the control wave form contains a large number of notches in each half cycle, since the high frequency components which are present in the wave form allow smaller values of passive divertor components to be practical.

Figure 2C:
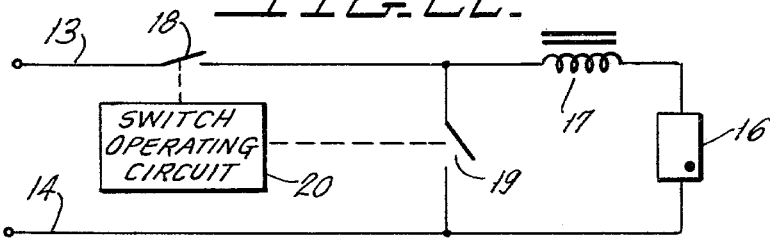
FIG. 2*c* shows an embodiment of the invention applied to a low power fluorescent lamp.

FIG. 2*c* shows an embodiment of the invention as applied to a single 20 watt fluorescent lamp. The ballast for lamp 16 is a low power factor ballast such as Universal Type 284.

Figure 2D:
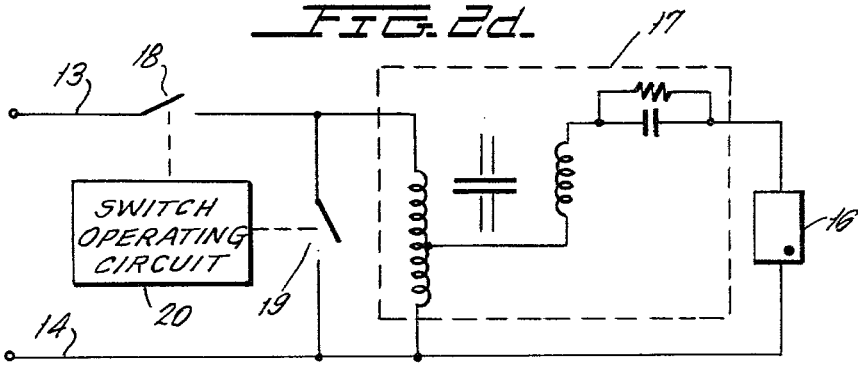
FIG. 2*d* shows an embodiment of the invention applied to a High Intensity Discharge lamp.

FIG. 2*d* shows the invention applied to a High Intensity Discharge Lamp (HID) 16 which can be a 400 watt metal halide lamp or mercury vapor lamp. The ballast 17 in that case is shown in dotted lines and may be an HID Ballast Universal Type 1130-93.

Figure 4:
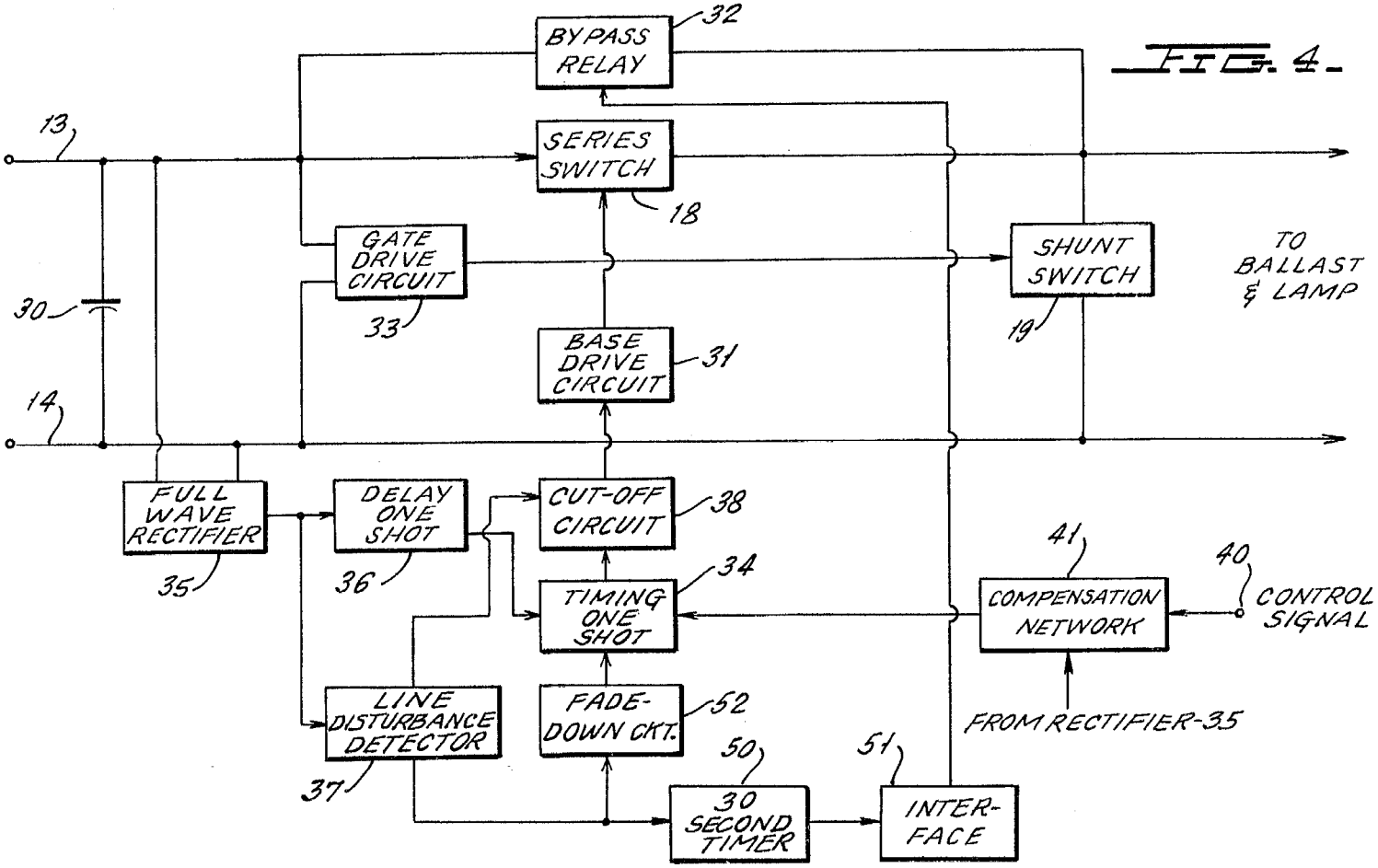
FIG. 4 is a more detailed block diagram of a circuit arrangement using the present invention and shows the various novel protective circuits.

A detailed block diagram of a preferred arrangement for carrying out the invention is shown in FIG. 4. In FIG. 4 there is shown the input a-c lines 13 and 14 of FIG. 2. The output of the block diagram is supplied to the labelled ballast and lamp which could consist of the ballast 17 and lamp 16 of FIG. 2 or any other suitable ballast and lamp combination. The series switch 18 and shunt switch 19 are also provided as shown.

Figure 5A:
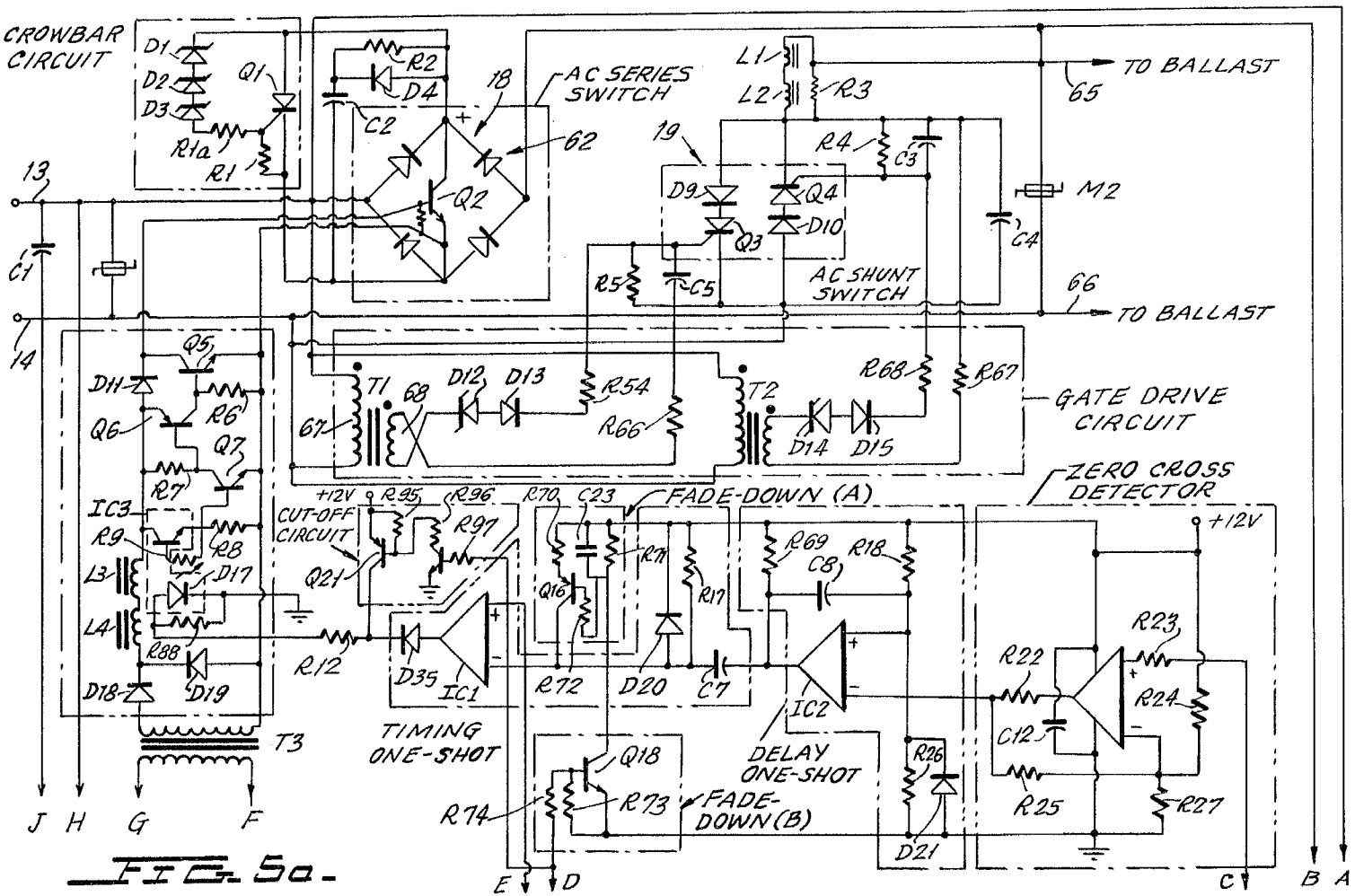
FIGS. 5*a* and 5*b* are parts of a detailed circuit diagram of a preferred circuit which carries out the present invention.

The series switch 18 may be any desired switch but, preferably, is an electronic switch and, typically, could include a high power transistor such as transistor type MJ10016 manufactured by Motorola contained within a full wave, bridge-connected rectifier as shown in FIG. 5*a*. The switch 18 is a switching transistor and will have a very low impedance when it is in its on state and an essentially open circuit in its off state. Series switch 18 is switched on and off under the control of a base drive circuit 31 which will be later described.

Switch 19 can be implemented by oppositely poled thyristors or by any other desired switching device.

An input capacitor 30 is connected directly across the a-c lines 13 and 14. The capacitor 30 should be provided because, when large currents are interrupted by the series switch 18 during each half cycle, energy stored in transformer leakage or line inductance of the a-c distribution system must be clamped to prevent a large voltage spike from appearing at the input of the circuit which could damage the circuit components. The input capacitor 30 provides a reservoir for this energy while allowing only a small safe increase in line voltage. Typically, capacitor 30 can be 10 microfarads for a line voltage of 277 volts a-c.

The normal current carrying capability of the a-c series switch 18 is sufficient to handle the normal full load output current of the ballast and lamp with adequate safety margin. However, when the a-c line voltage is initially applied, the first half cycle of current to the ballast may be ten times its normal value due to momentary saturation of the ballast magnetic components. To prevent damage to the a-c series switch 18 by this momentary high in-rush current, a bypass relay 32 is provided to handle the initial current.

Relay 32 may be a normally closed electromagnetic relay or any other desired type switching device. When a-c line voltage is applied, current immediately flows to the ballast through the bypass relay 32 with no regulation of the current by the series switch 18. The bypass relay 32 opens after some predetermined time delay to permit the series switch 18 to assume control of the energy to be applied to the ballast and lamps. Thus, the series switch 18 assumes control of the current only after the normal inrush current has disappeared and the line current assumes a normal value.

The bypass relay 32 opening is also delayed long enough to ensure that full line voltage is applied to the ballast and lamps for a sufficient time after each start-up to ensure that the lamps have reached a hot cathode discharge condition. This eliminates the danger of immediately operating the lamps at reduced voltage and with insufficient cathode heating which might substantially reduce the life of the lamps. Typically, relay 32 will not open for 30 seconds following the application of voltage to lines 13 and 14.

The a-c shunt switch 19 is functionally similar to the series switch 18 and has very low on-resistance and very high off-resistance. Switch 19 can, however, consist of back-to-back connected thyristors which can, for example, be of a Type 2N6405 connected in series with respective diodes for increased reverse-voltage blocking capability. The appropriately poled thyristor will be fired during the appropriate half cycle. The state of the shunt switch 19 can be easily generated by simply observing the polarity of the a-c line voltage and activating the proper polarity shunting element. This control is obtained through the gate drive circuit 33 which is connected directly to the a-c lines 13 and 14.

The base drive circuit 31, which controls series switch 18, operates in response to signals produced by a timing one-shot 34. The base drive circuit 31 also provides isolation for relatively low voltage control circuitry from the relatively high line voltages present on the a-c series switch. Thus, low voltage control circuitry can be properly grounded to ensure the safety of the operator.

The remaining circuitry shown in the block diagram of FIG. 4 generates the proper off period in the notched region previously discussed and provides safe turn-on and shut-down when the a-c line voltage is applied or removed from the circuit.

Power is applied to the control circuits through a full wave rectifier 35 which provides a full wave rectified version of the a-c line voltage to the delay one-shot 36 and to the line disturbance detector circuit 37. The use of the full wave rectifier 35 and of common control circuits for each half cycle permits very accurate determinations of the instant of a-c line voltage zero crossing.

After each line voltage zero crossing, the delay one-shot 36 provides a fixed pause before the start of the off period. This is the delay, for example, between time $t_0$ and $t_1$ in FIG. *3a*. In a preferred embodiment of the invention, the time delay is 3.2 milliseconds in a 60 Hertz system.

After the completion of the pause, the timing one-shot 34 causes the a-c series switch 18 to open for a time period determined by the setting of a control signal connected to terminal 40 through a compensation network 41. The length of this second pause, which may be from 0 to 2 milliseconds, will produce the desired regulation of the output light of the lamps operated by the circuit of FIG. 4.

The control signal 40 can be produced in any desired way as by a manually varied potentiometer; the output of a light sensor located in a lighted area whose light is to be maintained constant; or any other desired exterally generated controlled signal. Once the one-shot 34 times out at time $t_2$ in FIG. *3a*, which is variable adjusted as indicated by the arrow 42, the series switch 18 recloses. Note that a plurality of off periods or notches could have been used if desired.

By using a full wave rectified reference wave form from rectifier 35 and the same delay and timing circuitry for each half cycle, the off period will be identical in the positive and negative half cycles. This is important because any asymmetry between positive and negative half cycles can produce a d-c component in the output wave form. When using inductive ballasts, a d-c component may permit large currents to flow in the ballast, causing the ballast to overheat or causing the lamps to flicker. In severe cases, the current might rise to a large enough value to damage the circuit components or cause branch circuit breakers to operate.

The circuit of the invention could be implemented without the full wave rectifier 35 and common timing means for each cycle, but means may be needed to detect a d-c current in the ballast and means may have to be provided for correcting the output current. A d-c detection circuit can also be useful in the arrangement of FIG. 4 to simply monitor the output current for a d-c component and then trim the notch width in, for example, only the positive half waves, to remove the d-c component.

When implementing the timing one-shot 34 and the compensation network 41, the circuits should be arranged to cause the off period to be slightly reduced if the a-c line voltage drops and slightly increased if the voltage rises. This will keep the lamp output relatively constant with variations in the a-c line voltage. This feature of the compensation network 41 is desirable because, if the lamp output is set to a minimum level at which lamp life is still acceptable, a small decrease in line voltage could cause sufficient reduction in lamp output to drastically reduce lamp life. By employing the compensation scheme described above, it is possible to obtain maximum lamp control range without danger of the lamp damage due to normal variations in a-c line voltage.

The timing one-shot 34 is controlled by a suitable fade-down circuit 52 to prevent rapid changes in light output when the lamps are initially reduced from full output to the desired level following system energization or reset due to a line disturbance.

The line disturbance detector 37 continuously monitors the a-c line voltage for deviations outside of some preset range of normal voltage variations. Once a deviation beyond the normal is detected and lasts for one-half cycle, the line disturbance detector delivers a signal to a cut-off circuit 38 which bypasses and overrides the timing one-shot 34 and directly operates the base drive of the series switch 18 to turn the series switch off for a predetermined time, for example, 50 msec. and then to close relay 32. If, by the end of the 50 msec. interval, line voltage returns to normal, the circuit can automatically go through its normal start-up sequence, turning on the system again in a safe manner. Of course, if the a-c line voltage does not return to normal before the period has elapsed, the system simply remains off until reset.

The one-half cycle drop-out feature within detector 37 ensures that the lamps will not be re-excited in a dim condition if a voltage failure occurs during a dim condition and the lamps go out, but line voltage comes back to re-excite the lamp. The lamps would then have to restart under a dim condition, thereby causing possible damage to the lamps. However, by causing the circuit to shut down for at least some determined time and then causing the circuit to restart in a normal restart procedure, the lamps will re-strike under full line voltage (the relay 34 is closed) so that the lamps can restart properly.

The line disturbance detector also causes the circuit to drop out when the line voltage is too low, thereby preventing lamp damage due to too low a filament voltage if rapid start fluorescent lamps are used. Note further that bypass relay 32 will also be held closed for 30 seconds after initial closing to allow lamp filaments to be heated properly before they can be operated in the dimming mode.

The normal start-up will occur through the 30 second timer delay 50 and a suitable interface circuit 51, which controls the bypass relay 32 as previously described.

Interface circuit 51 acts also to keep the bypass relay 32 open during the turn off of the circuit. Thus, cut-off circuit 38 acts immediately to cut off switch 18 whenever voltage on lines 13 and 14 is removed as due to opening a contactor. By keeping relay 32 open, the entire circuit will be well protected from potentially damaging transients generated by bouncing switch contacts of the contactors associated with the lines 13 and 14. It is very important that the unit be be well protected from transient damage during start-up and shut-down since, in retrofit and other installations the a-c line to the unit will generally be switched by a wall switch or circuit breaker which tends to generate large numbers of transients upon each switching action.

It will be apparent that many modifications can be made while still practicing the invention. For example, bypass relay 32 could be eliminated if the a-c series switch 18 has sufficient peak current capability to safely handle ballast in-rush current. Similarly, the one-shot timing chain and full wave rectifier arrangement could be replaced with a digital phase-locked loop control generator. Other equivalents could also be used in the control and operating circuit. However, the preferred embodiment of the invention, as outlined in FIG. 4, presents a simple, reliable and producible implementation for the invention which gives satisfactory performance in a gas-discharge lamp retrofit control system.

FIG. 6 shows an arrangement whereby a single power control system such as that of FIG. 4 or any other suitable controller drives a plurality of lamps which may be arranged in banks which are to be selectively turned off and on. For example, one circuit of the kind shown in FIG. 4 can operate 90 forty watt rapid start fluorescent lamps, arranged in two or more banks having local switches.

In FIG. 6, the control circuit 300 may be that of FIG. 4 and the fixtures containing lamps and ballasts are arrayed in a plurality of areas shown as areas I and II having their own manually operable area switches 301 and 302, respectively. Relays having contacts 303 and 304 and relay coils 305 and 306, respectively, are provided with suitable time delay operating circuits 307 and 308, respectively. The circuit of FIG. 6 operates such that switches 301 and 302 can independently be closed to initially connect a-c line 13 directly to fixtures in area I or area II, bypassing the control circuit 300 and ensuring full voltage on the area fixtures to reliably start and warm up its lamps. After a given time delay, for example 30 seconds, set by time delay circuits 307 and 308, contacts 303 or 304 or both will be operated by coils 305 and 306, respectively, to connect the control circuit 300 to the fixtures.

The system of FIG. 6 requires additional wire 309 which must run to each local area. FIG. 7 shows an arrangement where the added wire is not needed. FIG. 7 shows only the area I fixtures of FIG. 6 but it will be apparent that any number of area groups will be provided. A step-up autotransformer is provided for each area, shown as transformer 320 in FIG. 7. Thus, when switch 301 is closed, step-up transformer 320 increases the voltage amplitude output of control circuit by about 10% to 20% for a time delay of about 30 seconds, when the relay contact 303 operates to open the output winding portion of transformer 320 to apply the output voltage of circuit 300 directly to the area I fixtures. Clearly each of the other areas will have a similar transformer 320, which operate independently of one another.

FIG. 8 shows a further embodiment of the invention which may be used when the control circuit 300 is that of FIG. 4. A capacitor 330 is switched across the output of circuit 300 at the turn on of its respective area. Capacitor 330 stores energy received during intervals when the output of circuit 300 is at a high level in each half cycle, and returns this energy to the load when the circuit 300 turns off. In effect the stored energy of capacitor 330 will "fill-in" the notches in the output wave form of circuit 300 during the start-up interval. This causes the output of circuit 300 to more closely resemble the line voltage and provides reliable striking. This scheme is most practical with multiple notches to keep capacitor size practical.

Of course, equivalent components can be substituted in the circuits of FIGS. 6, 7 and 8 without changing the concept. Thus, solid state switching can be used in place of the relays shown, alternate energy storage means may be used and the time delay could be replaced by manual switching or any other suitable scheme for switching from the starting mode to the operating mode.

Figure 5B:
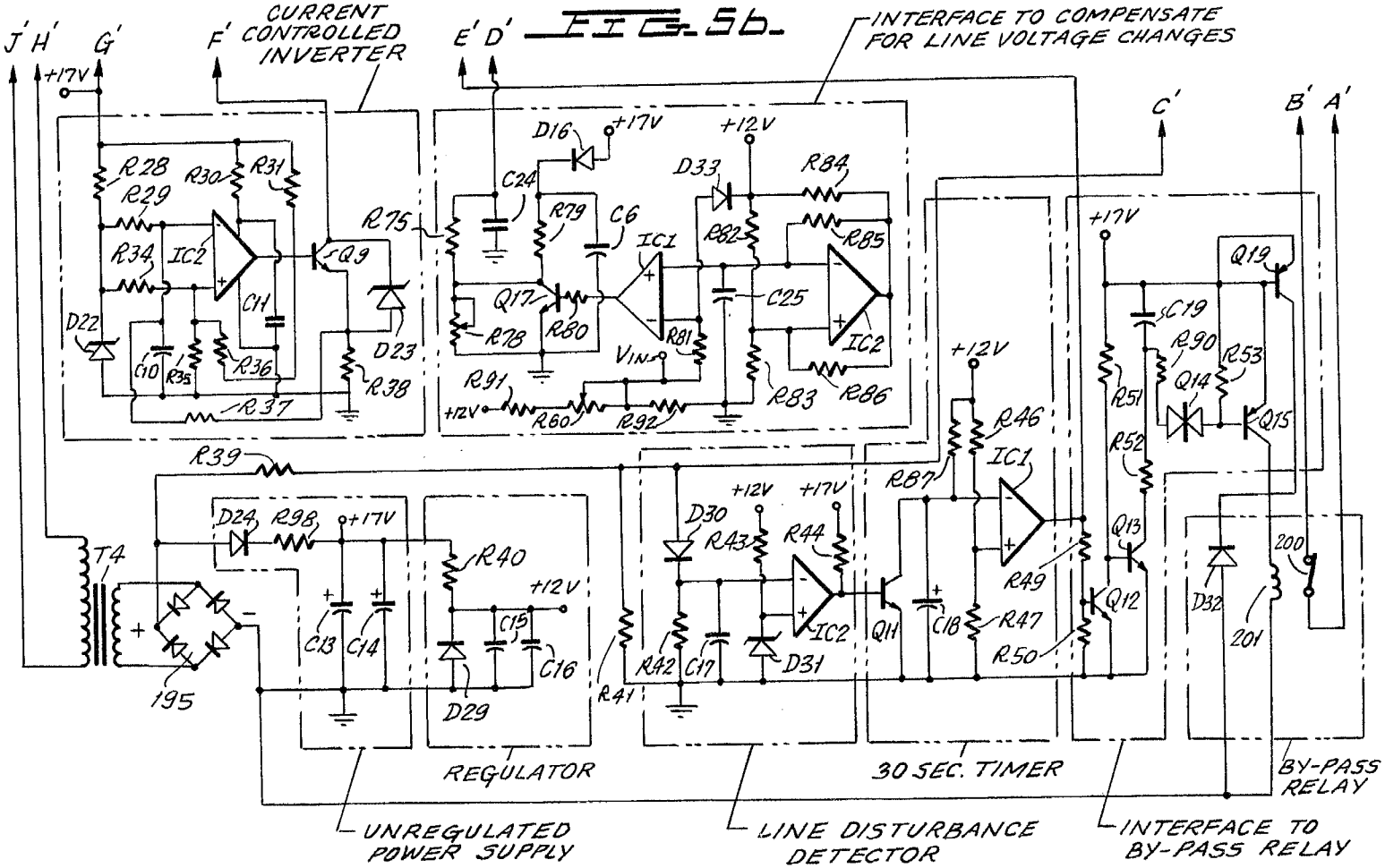

The detailed circuit diagram of a preferred embodiment of the present invention is separated, for convenience, into FIGS. 5*a* and 5*b*. The embodiment of FIGS. 5*a* and 5*b* has a line input terminal connected to line 13 and a neutral terminal connected to line 14. The input voltage across lines 13 and 14 is 277 volts a-c. Capacitor 30 of FIG. 4 is shown in FIG. 5*a* as the capacitor $C_1$ and a metal oxide varistor $M_1$ is connected across capacitor $C_1$.

The a-c switch 18 of FIG. 4 consists of the switching transistor $Q_2$ which is connected between the d-c terminals of the single phase, full wave bridge 62. The a-c terminals of the bridge 62 are powered by power lines 13 and 65, as shown. The d-c terminals of the bridge 62 are connected to a snubber circuit including the resistor $R_2$ and diode $D_4$, which are connected in series with capacitor $C_2$. Also connected across the d-c terminals of the bridge 62 is a "crowbar" circuit which protects transistor $Q_2$ against overvoltages and includes a controlled rectifier $Q_1$ having its anode and cathode terminals connected directly across the d-c terminals of the bridge 62, with a control circuit including resistor $R_1$ and zener diodes $D_1$, $D_2$ and $D_3$ and a resistor $R_{1a}$ connected to the gate of SCR $Q_1$.

The shunt switch 19 of the previous figures consists in FIG. 5*a* of controlled rectifiers $Q_3$ and $Q_4$ which are oppositely poled and which are in series with respective diodes $D_9$ and $D_{10}$.

A snubber circuit is also provided for the shunt switch 18 consisting of 100 microhenry chokes $L_1$ and $L_2$ which are connected to the resistor $R_3$, the metal oxide varistor $M_2$ and capacitor $C_4$. The output leads to the ballast include the output leads 65 and 66 which are connected across the shunt switch arrangement.

The gate drive circuits corresponding to gate drive block 33 in FIG. 4 derive their energy directly from the lines 13 and 14. Lines 13 and 14 are connected to the primary winding of transformer $T_1$ which may have a turns ratio of 277 to 24 between its primary winding 67 and its secondary winding 68. A second transformer $T_2$ of structure identical to that of transformer $T_1$ is also provided.

The output of the second winding of transformer $T_1$ is then connected to the gate circuit of controlled rectifier $Q_3$ through the 12 volt zener diode $D_{12}$, diode $D_{13}$, resistor $R_5$, capacitor $C_5$ and resistor $R_{66}$. The gate drive for controlled rectifier $Q_4$ of the shunt switch 19 is identical to that of controlled rectifier $Q_3$ and includes a 12 volt zener $D_{14}$, diode $D_{15}$, resistor $R_{66}$, resistor $R_4$, capacitor $C_3$ and resistor $R_{67}$. It will be apparent that the gate drive circuits for the switch 19 operate such that when the series switch 18 conducts, the shunt SCR will be turned off.

Next described are the base drive circuits for driving the base of the series switch containing transistor $Q_2$. The base emitter circuit of transistor $Q_2$ has a 10 ohm resistor thereacross which is connected to the base emitter circuit of the main base drive transistor $Q_5$. As will be seen, the transistor $Q_5$ is turned on in order to turn off transistor $Q_2$ and produce a notch in the wave form to be applied to the output leads 65 and 66. It will also be seen that the control of the transistor $Q_5$ is ultimately derived from the signal from resistor $R_{12}$ into the opto-coupler $IC_3$.

The base input to transistor $Q_5$ is controlled by an amplifier which includes resistors $R_6$, $R_7$ and $R_8$, diode $D_{11}$, transistor $Q_6$ and the transistor of $IC_3$. Integrated circuit $IC_3$ is an electro-optical coupler which responds to the output light of LED $D_{17}$ which controls the photosensitive output transistor in $IC_3$. A small resistor $R_{88}$ is connected across the diode $D_{17}$ in the opto-coupler.

Input power to the base drive amplifier is derived from a transformer $T_3$ having a 50-turn primary and a 40-turn secondary where the transformer uses a ferrite core. The transformer secondary winding is connected to the diodes $D_{18}$ and $D_{19}$ and diodes $D_{18}$ and $D_{19}$ are connected in series with filter chokes $L_3$ and $L_4$.

The primary winding of transformer $T_3$ is connected to a current controlled inverter for converting the unregulated 17 volts d-c at terminal +17 to an a-c input to the primary winding of transformer $T_3$. The current controlled inverter consists of resistors $R_{28}$, $R_{29}$, $R_{30}$, $R_{31}$, $R_{34}$, $R_{35}$, $R_{36}$, $R_{37}$ and $R_{38}$; capacitors $C_{10}$ and $C_{11}$; zener diodes $D_{22}$ (2.4 volts) and $D_{23}$ (68 volts); transistor $Q_9$ and a portion of integrated circuit $IC_2$ which is a type LM339 integrated circuit. Other portions of $IC_2$ are used in other parts of the circuit of FIGS. 5*a* and 5*b* as will be later described.

Referring next to the full wave rectifier for driving the control circuits, it will be seen in the bottom left-hand corner of FIG. 5*b* that there is a transformer $T_4$ which is a step-down transformer having a primary winding connected to terminals 13 and 14 and a secondary winding connected to the single phase, full wave bridge-connected rectifier 195. The turns ratio of transformer $T_4$ is such that it will produce a voltage step down of 277 volts to 12 volts. As described previously, the use of the novel full wave rectifier will produce symmetry of operation between the positive and negative half cycle loops of the wave form applied to the ballast at lines 65 and 66.

Output resistors $R_{39}$ and $R_{41}$ are connected to the positive output terminal of the full wave rectifier 195.

The output of the full wave rectifier 195 is divided between an unregulated power supply circuit, wherein the output voltage varies with the input voltage at terminals 13 and 14, and a regulated output circuit for control of some of the circuit components. The unregulated supply circuit components include resistor $R_{98}$, diode $D_{24}$ and capacitors $C_{13}$ and $C_{14}$. These are each connected to the terminal +17 which identifies an output voltage of 17 volts-unregulated. Other terminals throughout the circuit which are connected to this unregulated voltage are also identified as +17 terminals.

The regulated power supply is produced by the components including resistor $R_{40}$ the 12-volt zener diode $D_{29}$ and capacitors $C_{15}$ and $C_{16}$. These components are connected to the terminal labeled +12 volts which is a regulated voltage and is the terminal connected to the other +12 V terminals located throughout the circuit diagram of FIGS. 5*a* and 5*b* which are used where a regulated voltage source is required.

The line voltage disturbance detector of FIG. 4 is shown in FIG. 5*b* at the immediate right of the a-c full wave rectifier and consists of diode $D_{30}$, 5.6 volt zener $D_{31}$, resistor $R_{42}$, resistor $R_{43}$, resistor $R_{44}$, capacitor $C_{17}$ and a portion of the integrated circuit $IC_2$ including pins 2, 4 and 5 of that integrated circuit. Resistor $R_{43}$ is connected to the regulated voltage +12 V while resistor $R_{44}$ is connected to the unregulated voltage +17 V. Resistor $R_{42}$ and capacitor $C_{17}$ of the above circuit serve as the ½ cycle timer portion of the line disturbance detector.

The line disturbance detector acts in such a manner that the comparator of $IC_2$ will trip if line voltage is interrupted or is reduced beyond some given magnitude for more than ½ cycle.

The output of the line disturbance detector is applied to a 30-second timer circuit (FIG. 5*b*) which includes transistor $Q_{11}$, capacitor $C_{18}$, resistors $R_{46}$, $R_{47}$ and $R_{87}$ and a portion of integrated circuit $IC_1$ including pins 5, 6 and 7 thereof. Integrated circuit $IC_1$ is a Type LM324 device. The 30-second timer circuit will operate to produce an output for 30 seconds following the appearance of a signal to $Q_{11}$ from the line disturbance detector. The purpose of the 30 second timer circuit is to allow sufficient time for the system to properly stabilize before control is attempted. One of the outputs of the 30-second timer is applied to an interface circuit which interfaces with the bypass relay.

The interface circuit (FIG. 5*b*) includes resistors $R_{49}$, $R_{50}$, $R_{51}$, $R_{52}$, $R_{53}$, $R_{90}$ and $R_{94}$. Also included are capacitor $C_{19}$, trigger device $Q_{14}$ and transistors $Q_{12}$, $Q_{13}$, $Q_{15}$ and $Q_{19}$.

The bypass relay itself is shown in FIG. 5*b* as a normally closed electro-magnetic relay having normally closed contact 200 operable by a coil 201. A diode $D_{32}$ is connected in parallel with coil 201. Contact 200 is connected directly across the a-c terminals of the a-c series switch 18 in FIG. 5*a*.

There is next shown in FIG. 5*b* a novel interface circuit which causes automatic change in the notch width of the wave form applied to the ballast in order to compensate for changes in line voltage. Thus, the line voltage at terminals 13 and 14 will vary between normal limits in any power system and it is important that the notch width be changed automatically to prevent the voltage applied to the ballast from reducing below some absolute minimum due to the normal variation in the input voltage. It is also desirable to provide such line voltage regulation by automatically changing the notch width to maintain a constant output light from the lamp. The novel interface circuit has a 17 volt unregulated input terminal connected to the diode $D_{16}$. The circuit output will ultimately control the current in resistor $R_{12}$ which is the input signal to the base drive circuit previously described.

The novel interface circuit includes resistors $R_{75}$, $R_{78}$, $R_{79}$, $R_{80}$, $R_{81}$, $R_{82}$, $R_{83}$, $R_{84}$, $R_{85}$ and $R_{86}$. Note that resistor $R_{78}$ is an adjustable resistor for low end trim. In addition, note that there is a terminal $V_{IN}$ connected to resistor $R_{81}$ which can act as an input control terminal causing the circuit to respond to some input voltage which can be derived, for example, from a photocell interface or any other source which is desired to cause control of the lamp attached to the ballast. In addition, a manual input control is provided consisting of the resistor divider including resistors $R_{91}$, $R_{92}$ and $R_{60}$. Resistor $R_{60}$ is an adjustable resistor which can serve for manual adjustment of the output of the system.

The interface circuit next includes capacitors $C_{24}$, $C_6$, $C_{25}$, transistor $Q_{17}$ and portions of integrated circuits $IC_1$ and $IC_2$ having the pins as noted.

The output from the full wave rectifier 195 is next connected to a zero-cross detector (FIG. 5*a*) which, in turn, will operate a fixed delay one-shot. The zero-cross detector includes resistors $R_{22}$, $R_{23}$, $R_{24}$, $R_{25}$. The zero-cross detector also includes a portion of integrated circuit $IC_1$ including pins 1, 2 and 3. Pins 4 and 11 of $IC_1$ are ground connections. Capacitor $C_{12}$ is a high frequency bypass to eliminate noise from source Vcc from getting into $IC_1$. The zero-cross detector acts to put out a signal at the instant the wave form to the ballast, as monitored by the full wave rectifier, crosses zero.

The zero-cross detector then operates the delay one-shot of FIGS. 4 and 5*a*. The delay one-shot is shown in FIG. 5*a* and includes resistors $R_{18}$, $R_{26}$, $R_{69}$, capacitor $C_8$, diode $D_{21}$ and a portion of the integrated circuit $IC_2$ including pins 8, 9 and 14 thereof. The delay one-shot begins timing for a fixed time delay of 3.2 milliseconds following a pulse from the zero-cross detector. In particular, the output of integrated circuit $IC_2$ is high for 3.2 milliseconds after which time it goes low and produces a voltage on the output capacitor $C_7$ of the timing one-shot which has the shape of a downward spike.

The timing one-shot shown in FIG. 5*a* includes resistor $R_{17}$; diodes $D_{35}$ and $D_{20}$; and a portion of integrated circuit $IC_1$ including pins 12, 13 and 14 thereof. The timing one-shot acts to produce an output on pin 14 of $IC_1$ which goes high when the d-c voltage goes above the output voltage of the downward spike of the dagger-shaped or spiked output of capacitor $C_7$, thereby to produce an output signal on resistor $R_{12}$ which turns on the LED $D_{17}$. This causes switching of transistor $Q_5$ and thus the desired notch configuration is produced by the a-c series switch 18.

A fade-down circuit is provided, shown in two sections (A) and (B) in FIG. 5*a*. The first portion of the fade-down circuit, labeled fade-down (A), includes resistors $R_{70}$, $R_{71}$ and $R_{72}$, capacitor $C_{23}$ and transistor $Q_{16}$.

The second portion of the fade-down circuit, labeled fade-down (B), consists of resistors $R_{73}$ and $R_{74}$ and transistor $Q_{18}$. The fade-down circuit will operate to delay rapid change in the signal output of the timing one-shot when the 30 second timer releases during the turn-on sequence as described further below.

FIG. 5*a* next contains a cutoff circuit which consists of the resistors $R_{95}$, $R_{96}$ and $R_{97}$ and transistors $Q_{20}$ and $Q_{21}$. The cutoff circuit will operate to force the a-c series switch to remain off under certain conditions by overriding the signal of the timing one-shot circuit.

In operation of the circuit of FIGS. 5*a* and 5*b*, it will be noted that whenever transistor $Q_5$ is on, a notch will be produced by the a-c series switch 18 in the output wave form applied to the ballast. Transistor $Q_5$ will turn on whenever a light output is produced by the LED $D_{17}$ in the optical coupling circuit $IC_3$. A signal will be produced by integrated circuit $IC_1$ (pin 14) to turn on the opto-coupler as long as an output signal below a given level appears on capacitor $C_7$. This signal on capacitor $C_7$ will have the shape of a downward spike which has a time duration given by the placement of the spike relative to a reference voltage. By raising or lowering the reference voltage, the length of time a signal will be produced to energize the opto-coupler can be controlled.

This voltage level is, in turn, controlled by the voltage impressed on resistor $R_{79}$ via the unregulated +17 supply. As line voltage increases, the +17 supply increases and the notch is widened. As line voltage decreases, the +17 supply decreases and the notch is narrowed.

The described variation in pulse width with the input voltage results in an essentially constant output over the normal range of input voltages encountered with a typical a-c supply line.

The turn-on sequence and turn-off sequence can now be described for the circuit of FIGS. 5*a* and 5*b*. Referring first to the turn-on sequence, power line terminals 13 and 14 are first energized by the closing of some suitable contactor in series with the line. The actuation of the power line produces the control power needed for immediate activation of the gate drive circuit. Transistor $Q_2$ is initially short-circuited by the closed relay contacts 200 so that surge current to the ballast will bypass transistor $Q_2$ through the relay contacts 200.

With the activation of the power line, the 30-second timer circuit begins timing. That is, when line voltage appears, comparator circuit $IC_2$ turns off transistor $Q_{11}$ and begins the timing of the circuit including capacitor $C_{18}$ and resistor $R_{87}$.

After 30 seconds, the output of $IC_1$ at pin 7 goes low. Transistor $Q_2$ then turns on, transistor $Q_{13}$ turns on, transistor $Q_{19}$ turns on and the contact 200 opens through the energization of the relay coil 201.

The transistor $Q_2$ is now turned on full (no notch exists) and the ballast and lamp have been turned on at full power for 30 seconds. If the control circuit calls for a given notch width to reduce the power output to the lamp, the light will gradually fade to the desired value by the action of the fade down circuit previously described. The adjustment of the value of potentiometer $R_{60}$ in the interface to compensate for line voltage changes is the component which will call for a particular output level. There may, however, be other control inputs such as photosensor inputs and the like.

The d-c level set by resistor $R_{60}$ is applied to pin 9 of integrated circuit $IC_1$ and a triangular signal wave form is applied to pin 10 of integrated circuit $IC_2$. So long as the voltage at pin 9 is higher than that of pin 10, transistor $Q_{17}$ turns off and applies an output via resistor $R_{79}$ according to +17 level to the RC filter consisting of resistor $R_{75}$ and capacitor $C_{24}$. This output is the d-c signal to control the timing one-shot and the notch width of the wave form applied to the ballast and the lamp. The circuit is now in normal turned-on operation.

In order to turn off the circuit, a novel sequence is followed whereby line power is first turned off. When the line power is turned off, the gate drive disappears and the line disturbance detector circuit trips.

The main transistor $Q_2$ immediately turns off for the reason that the 30-second timer is immediately reset and activates the cutoff circuit to override the circuit which produces the notched current wave form and turns on the LED $D_{17}$ which turns on transistor $Q_5$. This in turn shuts off transistor $Q_2$.

Capacitors $C_{13}$ and $C_{14}$ in the unregulated power supply are preferably electrolytic capacitors which can store enough power to allow the above operation to occur even though line power has been disconnected.

Thereafter and if the contactor in series with lines 13 and 14 bounces during the shutoff, the crowbar circuit including controlled rectifier $Q_1$ will close in order to protect transistor $Q_2$ from damage. The relay contact 200 then closes to fully protect the transistor $Q_2$ for the next turn-on sequence.

Note specifically that if the relay contacts 200 were immediately closed with the removal of line power and before the dissipation of energy which might be stored in the various reactive components of the circuit, the controlled rectifiers $Q_3$ and $Q_4$ would be in the circuit without a gate drive. Thus, a fast rising surge could damage the forward biased controlled rectifier. For this reason, the relay contacts 200 are held open for a short time following the turn off of line power. This delay is obtained through the capacitor $C_{17}$ and resistor $R_{90}$ which act as a time delay to delay the de-energizing of coil 201 and the closing of contacts 200.

Note further that device $Q_{14}$ is at zero volts during the turn-off instant. Thus current circulates around the circuit including transistors $Q_{15}$, $Q_{19}$ and capacitor $C_{19}$ discharges for a given period of time. This then keeps transistor $Q_{15}$ and transistor $Q_{19}$ on for the necessary time delay.

In carrying out the circuit of FIGS. 5*a* and 5*b*, goods results were obtained using component values as follows:

| RESISTORS | |
|---|---|
| $R_1$ | 390r |
| $R_{1a}$ | 100r |
| $R_2$ | 390r |
| $R_3$ | 10r |
| $R_4$ | 390r |
| $R_5$ | 390r |
| $R_6$ | 18r |
| $R_7$ | 390r |
| $R_8$ | 10K |
| $R_9$ | 470K |
| $R_{12}$ | 2.7K |
| $R_{17}$ | 100K |
| $R_{18}$ | 100K |
| $R_{22}$ | 68K |
| $R_{23}$ | 10K |
| $R_{24}$ | 100K |
| $R_{25}$ | 470K |
| $R_{26}$ | 220K |
| $R_{27}$ | 4.7K |
| $R_{28}$ | 2.7K |
| $R_{29}$ | 22K |
| $R_{30}$ | 22r |
| $R_{31}$ | 3.9K |
| $R_{34}$ | 15K |
| $R_{35}$ | 6.8K |
| $R_{36}$ | 15K |
| $R_{37}$ | 2.7K |
| $R_{38}$ | 0.75r |
| $R_{39}$ | 1K |
| $R_{40}$ | 220r |
| $R_{41}$ | 1K |
| $R_{42}$ | 450K |
| $R_{43}$ | 10K |
| $R_{44}$ | 3.9K |
| $R_{46}$ | 150K |
| $R_{47}$ | 330K |
| $R_{49}$ | 100K |
| $R_{50}$ | 100K |
| $R_{51}$ | 18K |
| $R_{52}$ | 4.7K |
| $R_{53}$ | 22K |
| $R_{54}$ | 100r |
| $R_{60}$ | 100K |
| $R_{66}$ | 100r |
| $R_{67}$ | 100r |
| $R_{68}$ | 100r |
| $R_{69}$ | 3.9K |
| $R_{70}$ | 1.8K |
| $R_{71}$ | 4.7K |
| $R_{72}$ | 10K |
| $R_{73}$ | 100K |
| $R_{74}$ | 47K |
| $R_{75}$ | 100K |
| $R_{78}$ | 10K (Adjustable) |
| $R_{79}$ | 10K |
| $R_{80}$ | 100K |
| $R_{81}$ | 100K |
| $R_{82}$ | 47K |
| $R_{83}$ | 47K |
| $R_{84}$ | 3.9K |
| $R_{85}$ | 47K |
| $R_{86}$ | 47K |
| $R_{87}$ | 1r |
| $R_{88}$ | 10K |
| $R_{90}$ | 1.8K |
| $R_{91}$ | 100K |
| $R_{92}$ | 100K |
| $R_{94}$ | 2.7K |
| $R_{95}$ | 100K |
| $R_{96}$ | 27K |
| $R_{97}$ | 100K |
| $R_{98}$ | 0.33r |

| CAPACITORS | |
|---|---|
| $C_1$ | 10 μfd |
| $C_2$ | 0.44 μfd |
| $C_3$ | 0.47 μfd |
| $C_4$ | 1 μfd |
| $C_5$ | 0.47 μfd |
| $C_6$ | 22 μfd |
| $C_7$ | .047 μfd |
| $C_8$ | .022 μfd |
| $C_{12}$ | 0.1 μfd |
| $C_{13}$ | 1000 μfd |
| $C_{14}$ | 1000 μfd |
| $C_{15}$ | 100 μfd |
| $C_{16}$ | 0.1 μfd |
| $C_{17}$ | .022 μfd |
| $C_{18}$ | 22 μfd |
| $C_{19}$ | 100 μfd |
| $C_{23}$ | 22 μfd |
| $C_{24}$ | 0.1 μfd |
| $C_{25}$ | 0.022 μfd |

| TRANSISTORS | |
|---|---|
| $Q_2$ | MJ10016 |
| $Q_3$ | 2N6504 |
| $Q_4$ | 2N6405 |
| $Q_5$ | 2N6288 |
| $Q_6$ | MPSA56 |
| $Q_9$ | D44E3 |
| $Q_{11}$ | 2N4123 |
| $Q_{12}$ | 2N4123 |
| $Q_{13}$ | 2N4123 |
| $Q_{15}$ | 2N4125 |
| $Q_{16}$ | 2N4125 |
| $Q_{17}$ | 2N4123 |
| $Q_{18}$ | 2N4123 |
| $Q_{19}$ | MJE-170 |
| $Q_{20}$ | 2N4123 |
| $Q_{21}$ | 2N4123 |

| DIODES | |
|---|---|
| $D_4$ | MR756 |
| $D_9$ | MR756 |
| $D_{10}$ | MR756 |
| $D_{11}$ | MR750 |
| $D_{13}$ | IN4001 |
| $D_{15}$ | IN4001 |
| $D_{16}$ | IN914 |
| $D_{18}$ | MR850 |
| $D_{19}$ | MR850 |
| $D_{20}$ | IN914 |
| $D_{21}$ | IN914 |
| $D_{24}$ | MR750 |
| $D_{30}$ | IN914 |
| $D_{32}$ | IN4002 |
| $D_{35}$ | IN914 |

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An illumination control system comprising:

a gas discharge lamp;

an a-c ballast means having a high power factor connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least one non-conductive region; said at least one non-conductive region disposed in each of the half waves of said a-c wave shape; said at least one region located between but not including adjacent zero magnitude crossovers of the voltage applied to said control circuit input a-c terminals; and adjustment means for varying the duration of said non-conductive region and the ratio of non-conductive time to conductive time during any half-cycle in order to control the intensity of the illumination output of said gas discharge lamp.

2. An illumination control system comprising:

a gas discharge lamp;

an a-c ballast means connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least one non-conductive region; said at least one non-conductive region disposed in each of the half waves of said a-c wave shape; said at least one region located between but not including adjacent zero magnitude crossovers of the voltage applied to said control circuit input a-c terminals;

adjustment means for varying the duration of said non-conductive region and the ratio of non-conductive time to conductive time during any half-cycle in order to control the intensity of the illumination output of said gas discharge lamp; and energy divertor means connected in closed series with said circuit means.

3. The control system of claim 1 wherein said wave shape has at least one further non-conductive region which includes at least one of the two zero magnitude crossovers associated with each half wave, whereby current does not flow through said circuit means during said at least one further non-conductive region.

4. The control system of claim 2 wherein said wave shape has at least one further non-conductive region which includes at least one of the zero magnitude crossovers associated with each half wave, whereby current does not flow through said circuit means during said at least one further non-conductive region.

5. An illumination control system comprising:

a gas discharge lamp;

an a-c ballast means having a high power factor connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least two non-conductive regions in each of the half waves of said a-c wave shape; said at least two non-conductive regions including both zero magnitude crossovers of each half cycle of the voltage applied to said control circuit input a-c terminals; and adjustment means for varying the duration of at least one of said two non-conductive regions and the ratio of non-conduction time to conduction time during any half-cycle in order to control the intensity of the illumination output of said gas discharge lamp.

6. An illumination control system comprising:

a gas discharge lamp;

an a-c ballast means connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least two non-conductive regions in each of the half waves of said a-c wave shape; said at least two non-conductive regions including both zero magnitude crossovers of each half cycle of the voltage applied to said control circuit input a-c terminals;

adjustment means for varying the duration of at least one of said two non-conductive regions and the ratio of non-conduction time to conduction time during any half-cycle in order to control the intensity of the illumination output of said gas discharge lamp;

and energy divertor means connected in closed series with said circuit means.

7. An illumination control system comprising:

a gas discharge lamp;

an a-c ballast means connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least one non-conductive region; said at least one non-conductive region disposed in each of the half waves of the said a-c wave shape;

adjustment means for varying the duration of said non-conductive region and the ratio of non-conductive time to conductive time during any half-cycle in order to control the intensity of the illumination output of said gas discharge lamp;

and energy divertor means connected directly across said cicuit means.

8. The control system of claim 2, 4 or 6 wherein said energy divertor means is connected directly across said a-c ballast input terminals.

9. The control system of claim 2, 4 or 6 wherein said energy divertor means is connected directly across said circuit means.

10. An illumination control system comprising:

a gas discharge lamp;

an a-c ballast means connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least one non-conductive region; said at least one non-conductive region disposed in each of the half waves of the said a-c wave shape;

said a-c wave shape having a phase control configuration;

adjustment means for varying the duration of said non-conductive region and the ratio of non-conductive time to conductive time during any half-cycle in order to control the intensity of the illumination output of said gas discharge lamp; and an energy divertor means connected across said a-c ballast means.

11. An illumination control system comprising:

a gas discharge lamp;

an a-c ballast means connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least one non-conductive region; said at least one non-conductive region disposed in each of the half waves of said a-c wave shape;

adjustment means for varying the duration of said non-conductive region and the ratio of non-conductive time to conductive time during any half-cycle in order to control the intensity of the illumination output of said gas discharge lamp;

and switching means connected directly across said a-c ballast input terminals.

12. The control system of claim 2, 4, 6 or 10 wherein said energy divertor means includes a passive element selected from the group consisting of capacitors, inductors, resistors and two terminal semiconductor devices.

13. The control system of claim 2, 4, 6 or 7 wherein said energy divertor means is a passive element.

14. The control system of claim 2, 4, 7 or 10 wherein said energy divertor means is a switch.

15. The control system of claim 13 wherein said passive element is a capacitor.

16. The control system of claim 1 or 2 wherein said lamp is a fluorescent lamp.

17. The control system of claim 1, 2, 7 or 11 wherein said current has a single non-conductive region in each of said half waves.

18. The control system of claim 17 wherein said single non-conductive region hs the same duration and the same location in each of said half waves.

19. The control system of claim 17 which further includes rate-of-change control means to cause the rate of change of said adjustment means not to exceed a suitable value.

20. The control system of claim 17 which includes adjustment means for varying the location of said non-conductive region within each of said half waves.

21. The control system of claim 20 which further includes rate-of-change control means to cause the rate of change of said adjustment means not to exceed a suitable value.

22. The control system of claim 1, 2, 7 or 11 wherein said current has at least two non-conductive regions in each of said half waves.

23. The control system of claim 21 wherein said non-conductive regions have the same duration and location in each of said half waves.

24. The control system of claim 22 which includes adjustment means for varying the location of at least one of said non-conductive regions within each of said half waves.

25. The control system of claim 3, 4, 5 or 6 wherein said non-conductive regions have the same duration and location in each of said half waves.

26. The control system of claim 3, 4, 5 or 6 which includes adjustment means for varying the location of at least one of said non-conductive regions within each of said half waves.

27. The control system of claim 26 which further includes rate-of-change control means to cause the rate of change of said adjustment means not to exceed a suitable value.

28. The control system of claim 1, 2, 3, 4, 5, 6, 7 or 11 which includes more than two non-conductive regions in each of said half waves.

29. The control system of claim 28 which further includes rate-of-change control means to cause the rate of change of said adjustment means not to exceed a suitable value.

30. The control system of claim 2, 4, 6 or 7 which includes multiplicity of said non-conductive regions in each of said half waves; said energy divertor comprising a capacitor.

31. The control system of claim 1, 2, 3, 4, 5, 6, 7 or 11 which includes a multiplicity of said non-conductive regions in each of said half waves.

32. The control system of claim 1, 2, 3, 4, 5, 6, 7 or 11 wherein said circuit means includes a controllably conductive device connected in series with said control circuit input a-c terminals and said control circuit output a-c terminals.

33. The control system of claim 32 wherein said controllably conductive device is open during any non-conductive region and closed at all other times.

34. The control system of claim 33 which further includes bypass switching means connected in parallel with said circuit means and between said control circuit input a-c terminals and said control circuit output a-c terminals and second circuit means for operating said bypass switching means responsive to predetermined circuit conditions.

35. The control system of claim 33 which further includes input capacitor means connected to said control circuit input a-c terminals to absorb transient voltage pulses including those generated by said circuit means.

36. The control system of claim 32 which further includes input capacitor means connected to said control circuit input a-c terminals to absorb transient voltage pulses including those generated by said circuit means.

37. The control system of claim 32 which further includes bypass switching means connected in parallel with said circuit means and between said control circuit input a-c terminals and said control circuit output a-c terminals and second circuit means for operating said bypass switching means responsive to predetermined circuit conditions.

38. The control system of claim 32 which further includes voltage responsive means connected to said control circuit input a-c terminals, and connection means connecting said voltage responsive means to said controllably conductive device for controllably varying the conduction of said device in accordance with a predetermined pattern.

39. The control system of claim 3, 4, 5 or 6 which further includes rate-of-change control means to cause the rate of change of said adjustment means not to exceed a suitable value.

40. An illumination control circuit for energizing a gas discharge lamp comprising:

an a-c ballast connected to said lamp and having a-c ballast input terminals;

a pair of a-c source terminals for connection to an a-c line;

a first controllably conductive switching device connected in series between said a-c source terminals and said a-c ballast input terminals;

first control means for switching said first controllably conductive switching device on and off to permit energy transfer from said a-c source terminals to said a-c ballast input terminals only when said first controllably conductive switching device is on, and producing at least one off region during each half cycle at a point in said half cycle between, but not including, its zero crossover regions;

a second controllably conductive switching device connected across said a-c ballast input terminals;

second control means for switching said second controllably conductive switching device on and off when said first controllably conductive device is off and on respectively;

and adjustment means for adjusting the duration of each of said off regions to produce dimming of the output of a lamp.

41. The circuit of claim 40 wherein said first switching device has only a single off operation during each half cycle.

42. The circuit of claim 40 wherein said first switching device comprises a high power transistor and a single phase, full wave, bridge-connected rectifier circuit; the emitter and collector terminals of said transistor connected to the d-c terminals of said bridge circuit; the a-c terminals of said bridge circuit connected in series with said a-c source terminals and said a-c ballast input terminals.

43. The circuit of claim 40 which includes normally closed relay means in parallel with said first switching device and time delay means for opening said relay means a predetermined time after rated a-c voltage appears at said a-c source terminals.

44. The circuit of claim 43 wherein all off regions for said first switching device occur at identical angles in each half cycle and have identical durations.

45. The circuit of claim 40 or 41 wherein said off region in each of said off periods begins at the same angle and ends at a variable angle in each half cycle.

46. The circuit of claim 40 or 42 wherein said second switching device includes first and second oppositely poled thyristors; said second control means including gate drive circuits connected directly to said a-c source terminals to operate in proper sequence.

47. An illumination control circuit for energizing a gas discharge lamp comprising:

an a-c ballast connected to said lamp and having a-c ballast input terminals;

a pair of a-c source terminals for connection to an a-c line;

a first controllably conductive switching device connected in series between said a-c source terminals and said a-c ballast input terminals;

first control means for switching said first controllably conductive switching device on and off to permit energy transfer from said a-c source terminals to said a-c ballast input terminals only when said first controllably conductive switching device is on, and producing at least one off region during each half cycle at a point in said half cycle between, but not including, its zero crossover regions;

a second controllably conductive switching device connected across said a-c ballast input terminals;

second control means for switching said second controllably conductive switching device on and off when said first controllably conductive device is off and on respectively; and normally closed relay means in parallel with said first switching device and time delay means for opening said relay means a predetermined time after rated a-c voltage appears at said a-c source terminals.

48. The circuit of claim 47 wherein the durations of each of said off regions are adjustable to produce dimming of the output of said lamp.

49. The circuit of claim 40 or 47 which further includes an input capacitor connected across said a-c source terminals to absorb voltage surges produced by the operation of said first switching device.

50. The circuit of claim 40 or 47 which further includes power supply means for providing operating power for said first control means; said power supply means including a full wave rectifier having a-c terminals connected to respective terminals of said a-c source terminals and providing symmetry for operating said first switching device on positive and negative half cycles.

51. The circuit of claim 40 or 47 wherein said first control circuit includes fixed timing circuit means for producing an output signal at the end of a first time following any zero crossover of the voltage of said a-c source terminals and variable timing circuit means producing an output for a variable time following the end of said first time connected to said first switching device and applying a signal to said first switching device for said variable time to turn said first switching device off for said variable time; and input control signal means connected to said variable timing circuit means.

52. The circuit of claim 51 which further includes power supply means for providing operating power for said first control means; said power supply means including a full wave rectifier having a-c terminals connected to respective terminals of said a-c source terminals and providing symmetry for operating said first switching device on positive and negative half cycles; said full wave rectifier connected to and operating said fixed timing circuit means.

53. The circuit of claim 52 wherein said fixed and variable time delay circuit means each comprise one-shot circuits.

54. The circuit of claim 40, 43 or 47 which further includes a-c line voltage monitor means connected to said a-c source terminals and cutoff circuit means connected thereto and connected to said first switching device; said line voltage monitor means producing an output signal to operate said cutoff circuit means when the voltage at said a-c source terminals varies beyond predetermined limits for a fixed given time; said cutoff circuit means thereafter preventing the closing of said first switching device for a second given time longer than said first given time.

55. The circuit of claim 54 which includes normally closed relay means in parallel with said first switching device and time delay means for opening said relay means a predetermined time after rated a-c voltage appears at said a-c source terminals; said voltage monitor means further connected to said relay means and closing said relay means when said voltage varies beyond said predetermined limits.

56. A gas discharge lamp lighting system comprising, in combination:

a plurality of separate groups of gas discharge lamps and ballasts therefor;

a main power source for energizing each of said plurality of groups;

a control circuit for modifying the power applied to said plurality of said groups;

first circuit means for each of said groups connecting its respective group to said main power source through said control circuit; each of said first circuit means including a respective first switching means;

second circuit means for each of said groups coupling its respective group to said main power source in a manner whereby the total power applied to its said group is unaffected by a power reduction due to any given state of said control circuits; each of said second circuit means including a respective second switching means;

said second circuit means being operable before said first circuit means to effect initial connection of their respective group of said plurality of groups to power from said power source, whereby said group will be initially operated by said power source and unaffected by the power regulation due to said control circuit, and whereby said first switching means of each of said groups is operated after said lamps have reached a desired operating temperature.

57. The lighting system of claim 56 which further includes time delay means coupling each of said first and second switching means of each of said groups to one another; said time delay means being operable to automatically close said first switching means a given time after the closing of said second switching means.

58. The lighting system of claim 56 or 57 wherein said second switching means is a local manually operable switch.

59. A gas discharge lamp lighting system comprising, in combination:

a plurality of separate groups of gas discharge lamps and ballasts therefor;

a main power source for energizing each of said plurality of groups;

a control circuit for modifying the power applied to said plurality of said groups;

first circuit means for each of said groups connecting its respective group to said main power source through said control circuit; each of said first circuit means including a respective first switching means;

second circuit means including respective voltage step-up means for each of said groups coupling its respective group to said main power source through said control circuit in a manner whereby the voltage applied to its said group is increased; each of said second circuit means including a respective second switching means operable to energize said step-up means;

said second circuit means being operable before said first circuit means to effect initial connection of their respective group of said plurality of groups to power from said power source through said voltage step-up means and said control circuit, whereby said group will be initially operated from an increased voltage, and whereby said first switching means of each of said groups is operated after said lamps have reached a desired operating temperature.

60. The system of claim 59 wherein said voltage step-up means is a voltage transformer.

61. The lighting system of claim 59 which further includes time delay means coupling each of said first and second switching means of each of said groups to one another; said time delay means being operable to automatically close said first switching means a given time after the closing of said second switching means.

62. The lighting system of claim 59 or 61 wherein said second switching means is a local manually operable switch.

63. A gas discharge lamp lighting system comprising, in combination:

a plurality of separate groups of gas discharge lamps and ballasts therefor;

a main power source for energizing each of said plurality of groups;

a control circuit for modifying the power applied to said plurality of said groups;

first circuit means for each of said groups connecting its respective group to said main power source through said control circuit; each of said first circuit means including a respective first switching means;

second circuit means including an energy storage means for each of said groups coupling its respective group to said main power source through said control circuit in a manner whereby the voltage wave shape applied to its said group is modified to be relatively unaffected by power reduction due to any given state of said control circuit; each of said second circuit means including a respective second switching means operable to connect said energy storage means;

said second circuit means being operable before said first circuit means to effect initial connection of their respective group of said plurality of groups to power from said power source, through said control circuit and said energy storage means, whereby said group will be initially relatively unaffected by the power regulation due to said control circuit, and whereby said first switching means of each of said groups is operated after said lamps have reached a desired operating temperature.

64. The system of claim 63 wherein said energy storage means is a capacitor.

65. The lighting system of claim 63 which further includes time delay means coupling each of said first and second switching means of each of said groups to one another; said time delay means being operable to automatically close said first switching means a given time after the closing of said second switching means.

66. The lighting system of claim 63 or 65 wherein said second switching means is a local manually operable switch.

67. An illumination control system comprising:

a gas discharge lamp;

an a-c ballast means connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least one non-conductive region; said at least one non-conductive region disposed in each of the half-waves of the said a-c wave shape; and adjustment means for varying the duration of said non-conductive region and the ratio of non-conductive time to conductive time during any half-cycle in order to control the intensity of the illumination output of said gas discharge lamp.

68. The control system of claim 67 wherein said current has at least two non-conductive regions in each of said half waves; and adjustment means for varying the location of at least one of said non-conductive regions within each of said half waves.

69. The control system of claim 68 which further includes energy divertor means connected directly across said circuit means.

70. The control system of claim 69 wherein said at least one region is located between but not including adjacent zero magnitude crossovers of the voltages applied to said control circuit input a-c terminals.

71. The control system of claim 68 wherein said a-c ballast has a high power factor, and wherein said at least one region is located between but not including adjacent zero magnitude crossovers of the voltages applied to said control circuit input a-c terminals.

72. The control system of claim 68 which further includes switching means connected directly across said a-c ballast input terminals.

73. An illumination control system comprising:

a gas discharge lamp;

an a-c ballast means connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has a single non-conductive region; said single non-conductive region disposed in each of the half waves of said a-c wave shape;

energy divertor means connected directly across said circuit means; and adjustment means for varying the location of said non-conductive region within each of said half waves.

74. The control system of claim 73 which further includes energy divertor means connected directly across said circuit means.

75. The control system of claim 74 wherein said at least one region is located between but not including adjacent zero magnitude crossovers of the voltages applied to said control circuit input a-c terminals.

76. The control system of claim 73 wherein said a-c ballast has a high power factor, and wherein said at least one region is located between but not including adjacent zero magnitude crossovers of the voltages applied to said control circuit input a-c terminals.

77. The control system of claim 73 which further includes switching means connected directly across said a-c ballast input terminals.

78. The control system of claim 75 or 76 wherein said wave shape has at least one further non-conductive region which includes at least one of the two zero magnitude crossovers associated with each half wave, whereby current does not flow through said circuit means during said at least one further non-conductive region.

79. The control system of claim 78 which further includes rate-of-change control means to cause the rate of change of said adjustment means not to exceed a suitable value.

80. The control system of claim 73, 74, 75, 76 or 77 which further includes rate-of-change control means to cause the rate of change of said adjustment means not to exceed a suitable value.

81. The control system of claim 1 which further includes rate-of-change control means to cause the rate of change of said adjustment means not to exceed a suitable value.

82. An illumination control system comprising:

a gas discharge lamp;

an a-c ballast means having a high power factor connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least two non-conductive regions in each of the half waves of said a-c wave shape; said at least two non-conductive regions including both zero magnitude crossovers of each half cycle of the voltage applied to said control circuit input a-c terminals; and adjustment means for varying the location of at least one of said non-conductive regions within each of said half waves.

83. An illumination control system comprising:

a gas discharge lamp;

an a-c ballast means connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least two non-conductive regions in each of the half waves of said a-c wave shape; said at least two non-conductive regions including both zero magnitude crossovers of each half cycle of the voltage applied to said control circuit input a-c terminals;

energy divertor means connected in closed series with said circuit means; and adjustment means for varying the location of at least one of said non-conductive regions within each of said half waves.

84. An illumination control system comprising:

a gas discharge lamp;

an a-c ballast means connected to said lamp and having a-c ballast input terminals;

a control circuit having input a-c terminals and output a-c terminals; said output a-c terminals connected to said a-c ballast input terminals;

said control circuit including circuit means for modifying the a-c wave shape of the voltage applied to said a-c ballast input terminals, whereby the current through said circuit means has at least one non-conductive region; said at least one non-conductive region disposed in each of the half waves of said a-c wave shape; said at least one region located between but not including adjacent zero magnitude crossovers of the voltage applied to said control circuit input a-c terminals;

energy divertor means connected in closed series with said circuit means; said energy divertor means including a capacitor.

* * * * *